US006219937B1

(12) United States Patent
Culp et al.

(10) Patent No.: US 6,219,937 B1
(45) Date of Patent: Apr. 24, 2001

(54) REHEATERS FOR KILNS, REHEATER-LIKE STRUCTURES, AND ASSOCIATED METHODS

(75) Inventors: George R. Culp, 44901 Old Highway 52, New London, NC (US) 28127; Robert T. Nagel, 6309 Valley Estates Dr., Raleigh, NC (US) 27612

(73) Assignees: George R. Culp, New London; Robert T. Nagel, Raleigh, both of NC (US)

( * ) Notice: Subject to any disclaimer, the term of this patent is extended or adjusted under 35 U.S.C. 154(b) by 0 days.

(21) Appl. No.: 09/538,177

(22) Filed: Mar. 30, 2000

(51) Int. Cl.[7] ..... F26B 7/00

(52) U.S. Cl. ..... 34/396; 34/508; 34/518; 34/218; 432/33; 432/88; 432/103

(58) Field of Search ..... 34/307, 396, 406, 34/403, 508, 518, 216, 218, 221, 229, 231; 432/33, 66, 88, 103, 144, 145, 199; 110/346, 229, 234

(56) References Cited

U.S. PATENT DOCUMENTS

| | | |
|---|---|---|
| Re. 15,316 | 3/1922 | Weiss . |
| 217,022 | 7/1879 | Robbins . |
| 528,496 | 10/1894 | Williams . |
| 1,039,301 | 9/1912 | Leaver . |
| 1,108,377 | 8/1914 | Leaver . |
| 1,268,180 | 6/1918 | Tiemann . |
| 1,366,225 | 1/1921 | Weiss . |
| 1,432,248 | 10/1922 | Hirt . |
| 1,461,393 | 7/1923 | Jenkinson . |
| 1,467,306 | 9/1923 | Carrier . |
| 1,539,817 | 5/1925 | Thelen . |
| 1,543,344 | 6/1925 | Thelen . |
| 1,594,549 | 8/1926 | Noel . |
| 1,603,103 | 10/1926 | Anderson . |
| 1,774,208 | 8/1930 | Mueller . |
| 1,778,586 | 10/1930 | Cobb . |

(List continued on next page.)

FOREIGN PATENT DOCUMENTS

| | | |
|---|---|---|
| 699870 | 12/1964 | (CA) . |
| 3321-673 | 6/1983 | (DE) . |
| 901772 | 2/1982 | (SU) . |

*Primary Examiner*—Stephen Gravini
(74) *Attorney, Agent, or Firm*—Alston & Bird LLP

(57) ABSTRACT

Elliptically shaped reheater conduits extend downward into a portion of a flow path that extends through a lower chamber interior space of a kiln chamber. Each of the reheater conduits has opposite ends, defines a length that extends between the opposite ends and is perpendicular to the portion of the flow path that extends through the lower chamber interior space, defines a first cross-dimension that is perpendicular to the length and parallel to the portion of the flow path, and defines a second cross-dimension that is perpendicular to both the length and the portion of the flow path. The second cross-dimension is less than the first cross-dimension. Each of the reheater conduits defines outlets positioned along the length of the reheater conduit. Each reheater conduit defines a pair of vertices between which its second cross-dimension is defined, and the outlets are proximate the vertices. The outlets of adjacent conduits are arranged so that jet-like flows from the outlets cooperate to produce whirling masses of air that travel downstream along the flow path to advantageously provide turbulence that interacts with a downstream stack of lumber. The jet-like flows from the outlets of the reheater conduits reach adjacent reheater conduits and advantageously interact with the boundary layers that extend around the adjacent reheater conduits. Movable dampers are respectively proximate the upper ends of the reheater conduits and are capable of being moved to adjust the amount of heated air supplied to the reheater conduits. Each reheater conduit advantageously includes an internal converging/diverging section proximate its upper end.

24 Claims, 13 Drawing Sheets

U.S. PATENT DOCUMENTS

| | | |
|---|---|---|
| 1,833,397 | 11/1931 | Hagen . |
| 1,840,523 | 1/1932 | Mueller . |
| 1,919,646 | 7/1933 | Woolhouse . |
| 1,964,115 | 6/1934 | Goodall . |
| 1,989,998 | 2/1935 | Mueller . |
| 1,995,675 | 3/1935 | Furbush . |
| 2,001,001 | 5/1935 | Thelen . |
| 2,006,018 | 6/1935 | Goodall . |
| 2,081,098 | 5/1937 | Steel . |
| 2,085,634 | 6/1937 | Cobb . |
| 2,318,027 | 5/1943 | Sykes et al. . |
| 2,380,518 | 7/1945 | Gottschalk et al. . |
| 2,538,888 | 1/1951 | Smith . |
| 2,718,713 | 9/1955 | Bloxham . |
| 2,736,108 | 2/1956 | Muyderman . |
| 2,821,029 | 1/1958 | Simons . |
| 2,825,274 | 3/1958 | Kurth et al. . |
| 3,129,071 | 4/1964 | Meredith . |
| 3,149,932 | 9/1964 | Bachrich . |
| 3,337,967 | 8/1967 | Smith . |
| 3,355,783 | 12/1967 | Miller et al. . |
| 3,363,324 | 1/1968 | Martin . |
| 3,367,040 | 2/1968 | Vani . |
| 3,386,186 | 6/1968 | Tiefenbach . |
| 3,417,486 | 12/1968 | Vanicek . |
| 3,584,395 | 6/1971 | Peters . |
| 3,659,352 | 5/1972 | Cook . |
| 3,675,600 | 7/1972 | Jones . |
| 3,716,004 | 2/1973 | Jones . |
| 3,757,428 | 9/1973 | Runciman . |
| 3,808,703 | 5/1974 | Kamiya . |
| 3,899,836 | 8/1975 | Johnson . |
| 3,932,946 | 1/1976 | Johnson . |
| 4,014,107 | 3/1977 | Bachrich . |
| 4,098,008 | 7/1978 | Schuette et al. . |
| 4,182,049 | 1/1980 | Lestraden . |
| 4,250,629 | 2/1981 | Lewis . |
| 4,343,095 | 8/1982 | Rosen et al. . |
| 4,344,237 | 8/1982 | Willington . |
| 4,380,877 | 4/1983 | Poux . |
| 4,556,043 | 12/1985 | Bratton . |
| 4,662,083 | 5/1987 | Carter et al. . |
| 4,683,668 | 8/1987 | Hondzinski et al. . |
| 4,753,020 | 6/1988 | Brunner . |
| 4,862,599 | 9/1989 | Brunner . |
| 4,955,146 | 9/1990 | Bollinger . |
| 5,107,607 | 4/1992 | Mason . |
| 5,195,251 | 3/1993 | Gyurcsek et al. . |
| 5,226,244 | 7/1993 | Carter et al. . |
| 5,276,980 | 1/1994 | Carter et al. . |
| 5,414,944 | 5/1995 | Culp et al. . |
| 5,416,985 | 5/1995 | Culp . |
| 5,437,109 | 8/1995 | Culp . |
| 5,488,785 | 2/1996 | Culp . |

REHEATERS FOR KILNS, REHEATER-LIKE STRUCTURES, AND ASSOCIATED METHODS

FIELD OF THE INVENTION

The present invention relates generally to the drying of green lumber in a kiln and, more particularly, to reheaters in kilns for drying lumber.

BACKGROUND OF THE INVENTION

Lumber which has recently been cut contains a relatively large percentage of water and is referred to as green lumber. Prior to being used in construction or other applications which demand good grades of lumber, the green lumber must be dried. Drying removes a large amount of water from the lumber and significantly reduces the potential for the lumber to become warped or cracked. Acceptable water content varies depending on the use of the lumber and type of wood; however, a moisture content of about nineteen percent, or less, is acceptable in many circumstances.

Although lumber may be dried in the ambient air, kiln drying accelerates and provides increased control over the drying process. In kiln drying, a charge of lumber is placed in a kiln chamber. The charge of lumber typically consists of two or more rectangular stacks of lumber. A typical kiln chamber is a generally rectangular building that can be at least partially sealed to control the amount of air that is introduced to and exhausted from the kiln chamber. Hot air from a furnace is forced through an inlet duct to a plenum that is positioned in an upper portion of the kiln chamber, and the hot air is discharged from the plenum to the chamber through multiple openings defined in the top of the plenum. The heated air supplied to the chamber is circulated within the chamber by fans so that the heated air flows along a flow path that extends through one or more upstream stacks of lumber, and thereafter through one or more downstream stacks of lumber.

Hot air from the plenum also flows into and escapes from a row of reheaters. It is conventional for each of the reheaters to be a downwardly extending pipe-like structure that extends from the bottom of the plenum, is positioned between the upstream and downstream stacks of the lumber, and extends into the portion of the flow path that is between the upstream and downstream stacks of the lumber. In some kilns, each of the reheaters is rectangular in a horizontal section and defines elongate vertical slits through which hot air flows into the chamber. The hot air discharged from the reheaters serves to further heat the air circulating through the kiln, thereby at least somewhat compensating for the heat that has been lost in drying the upstream stack of lumber prior to introducing the reheated air into the downstream stack of lumber. Unfortunately, the reheaters contribute to the resistance to flow along the flow path since they extend into the flow path.

Each stack of lumber being dried also contributes to the resistance to flow along the flow path. As best understood with reference to FIGS. 16–17, it is conventional for each stack 248 of a charge of lumber to consist of a number of vertically stacked, horizontal rows 250 of lumber 252 that are arranged such that cross-sections of the stack are generally rectangular. The horizontal rows 250 are spaced apart with narrow wooden boards 254, or the like, referred to as "stickers." The stickers 254 are positioned between each horizontal row 250 to space the rows apart so that multiple passages 256 are defined between adjacent layers and are open at the opposite sides of the stack 248. The heated air traveling along the flow path passes through the passages 256 and is in direct contact with both the upper and lower surfaces of individual pieces of lumber 252 so that the lumber is dried. For each of the passages 256, airflow therethrough is such that layers of viscous air are developed proximate to the surfaces of the pieces of lumber that face and define the passage. Those viscous layers are referred to as boundary layers 260. The boundary layers 260, which are areas of retarded flow, are caused by the viscous interaction between the airflow through the passage 256 and the surfaces of the pieces of lumber 252 that define the passage, as well as interaction between the airflow and the lumber surfaces that are proximate to the inlet opening of the passage.

Each boundary layer 260 includes an initially protruding portion 262 (i.e., a separated region) at the entrance of its passage 256. The protruding portion 262 tapers to a generally planar portion 264. For each of the boundary layers 260, the protruding portion 262 is a portion of the boundary layer that has become separated from the surface or surfaces of the one or more pieces of lumber 252 that define the passage. The separation occurs because of interaction between the airflow and an edge or edges of the one or more pieces of lumber 252 that define the inlet to the passage.

It is conventional for the edges of the layers of lumber 252 to be aligned so that they generally extend in a common plane. As a result, for each of the passages 256, the protruding portions 262 of the boundary layers 260 are aligned in a manner that is very restrictive to flow, since the boundary layers are regions of retarded flow and thereby tend to block flow into the passage. More specifically, an unrestricted flow path exists only in that region between the boundary layers 260 of each of the passages 256. Those unrestricted flow paths are characterized by generally fully developed two dimensional channel flow. Within each passage 256, the protruding portions 262 are aligned in a manner that causes a significant reduction in the size of the unrestricted flow path at the entrance of the passage. It is generally characterized as a poor entrance, similar to a flanged pipe condition but for a two dimensional channel.

The resistance to flow along the flow path that is caused by the reheaters and the stacks of lumber reduces the speed at which the pieces of lumber can be dried, which can be disadvantageous since mill production depends upon the ability to dry lumber at a sufficient rate so that production need not be slowed to allow for the drying process. The resistance to flow along the flow path that is caused by the reheaters and the stacks of lumber also requires significant pressure increases to maintain the flowrate; therefore, the kiln fans, which force the heated air to flow along the flow path, must work excessively, which is disadvantageous. Operating the fans of a kiln consumes energy that adds to the cost of producing quality lumber. Of course it is advantageous to lower the cost of producing quality lumber. Whereas some conventional kilns can be characterized as being efficiently operated and able to dry lumber at a sufficient rate, there is always a demand for new kilns and kiln-related structures that can be even more efficiently operated, and that facilitate the drying of lumber at a sufficient rate.

SUMMARY OF THE INVENTION

The present invention solves the above and other problems by providing improved reheater conduits, and the like. In accordance with one aspect of the present invention, the reheater conduits are elliptically shaped and extend downward from a plenum into a lower chamber interior space of a kiln chamber for supplying heated air from the plenum to the lower chamber interior space. One or more air moving devices circulate air in the lower chamber interior space along a flow path. The reheater conduits extend into a portion of the flow path and are generally perpendicular to the portion of the flow path. More specifically, each of the reheater conduits has opposite ends, defines a length that extends between the opposite ends and is generally perpendicular to the portion of the flow path, defines a first cross-dimension that is generally perpendicular to the length and parallel to the portion of the flow path, and defines a second cross-dimension that is perpendicular to both the length and the portion of the flow path. The second cross-dimension is less than the first cross-dimension so that the major axis of the elliptical reheater conduit is aligned with the flow path, thereby being less restrictive to flow along the flow path than if the first and second cross-dimensions were equal, in which case the cross section would be circular rather than elliptical.

In accordance with another aspect of the present invention, each of the reheater conduits defines outlets positioned along at least a section of the length of the reheater conduit. The reheater conduit defines a pair of vertices between which the second cross-dimension is defined. As such, the outlets of this embodiment are preferably proximate the vertices, which at least partially facilitates the aspects of the present invention that are described in the two immediately following paragraphs.

In accordance with another aspect of the present invention, the outlets of adjacent conduits are arranged so that jet-like flows from the outlets cooperate to produce turbulent whirling masses of air, known as vortices, that travel downstream along the flow path to eventually result in turbulence that interacts with a downstream stack of lumber. The vortices are formed by small jets issuing into the space between adjacent reheaters. The vortices break up as they flow toward the downstream lumber stack. The vortices naturally break up into turbulent eddies which then undergo decay from turbulent dissipation. The turbulence eventually decays to zero. However, the size of the initial vortices is selected so that the turbulence decays to a mean eddy size of approximately 0.05 inches. This is the mean integral scale. Eddies sized in this range interact with the downstream stack of lumber so as to restrict the separation of the boundary layers in the inlets of the passages extending through the downstream stack of lumber. This reduces the net resistance to flow through the downstream stack of lumber. That is, the whirling masses of air decrease the resistance to flow through the downstream stack(s) of lumber relative to the resistance to conventional flow through the downstream stack of lumber. More specifically, the turbulence resulting from the whirling masses reduces the size of the protruding separated regions of the boundary layers associated with the entrances to the passages defined through the downstream stack(s) of lumber and correspondingly increase the unrestricted flow path between the separated regions of the boundary layers.

In accordance with another aspect of the present invention, the jet-like flows from the outlets of the reheater conduits reach adjacent reheater conduits and interact with the boundary layers that extend generally around the adjacent reheater conduits so that separated regions of those boundary layers are smaller than they would be absent the jet-like flows. This enhances the convective heat transfer from the reheater conduits by increasing the airflow proximate the reheater conduits.

In accordance with another aspect of the present invention, movable dampers are respectively proximate the upper ends of the reheater conduits and are capable of being moved to respectively adjust the amount of heated air supplied to the reheater conduits. Each reheater conduit also preferably includes an internal converging/diverging section proximate its upper end for offsetting or balancing the effects of partially closing the inlet to the reheater conduit with the respective damper.

These and other aspects of the present invention are advantageous because they each pertain to either the efficient operation or timely operation of kilns.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
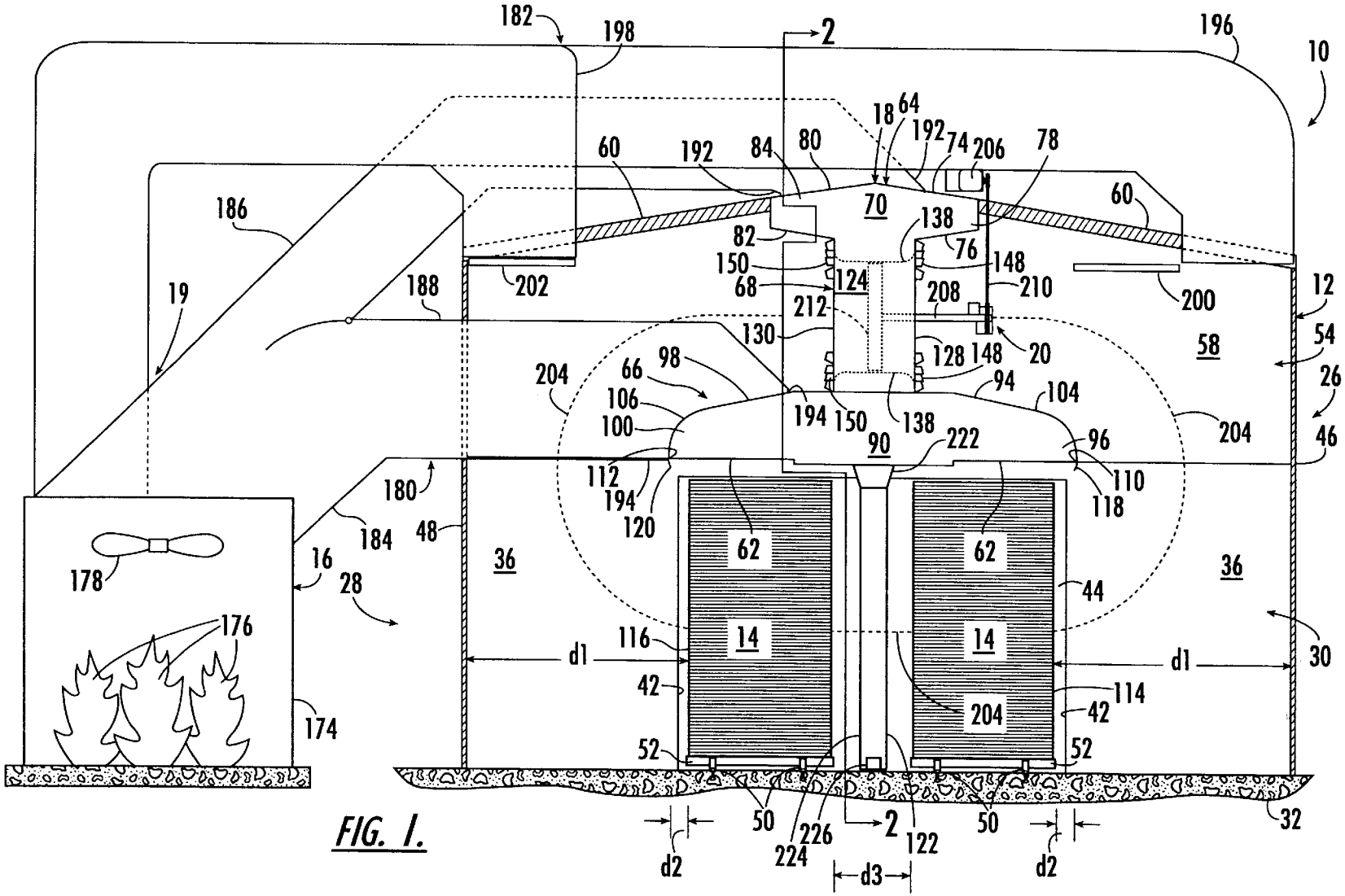
FIG. 1 is a schematic, front end, partially cross-sectional view of a kiln, in accordance with one embodiment of the present invention.

A kiln 10 of one embodiment of the present invention is schematically illustrated in FIG. 1, which is a partially cross-sectional front view. The operation of the kiln 10 of the illustrated embodiment of the present invention will initially be very generally described. The very general description will be followed by separate sections that respectively describe details about structures of the kiln 10, assembly of the kiln, and some exemplary operational aspects of the kiln. Some aspects of the present invention are described without regard to the sections, and the use of the sections is not intended to limit the scope of the present invention.

Figure 2:
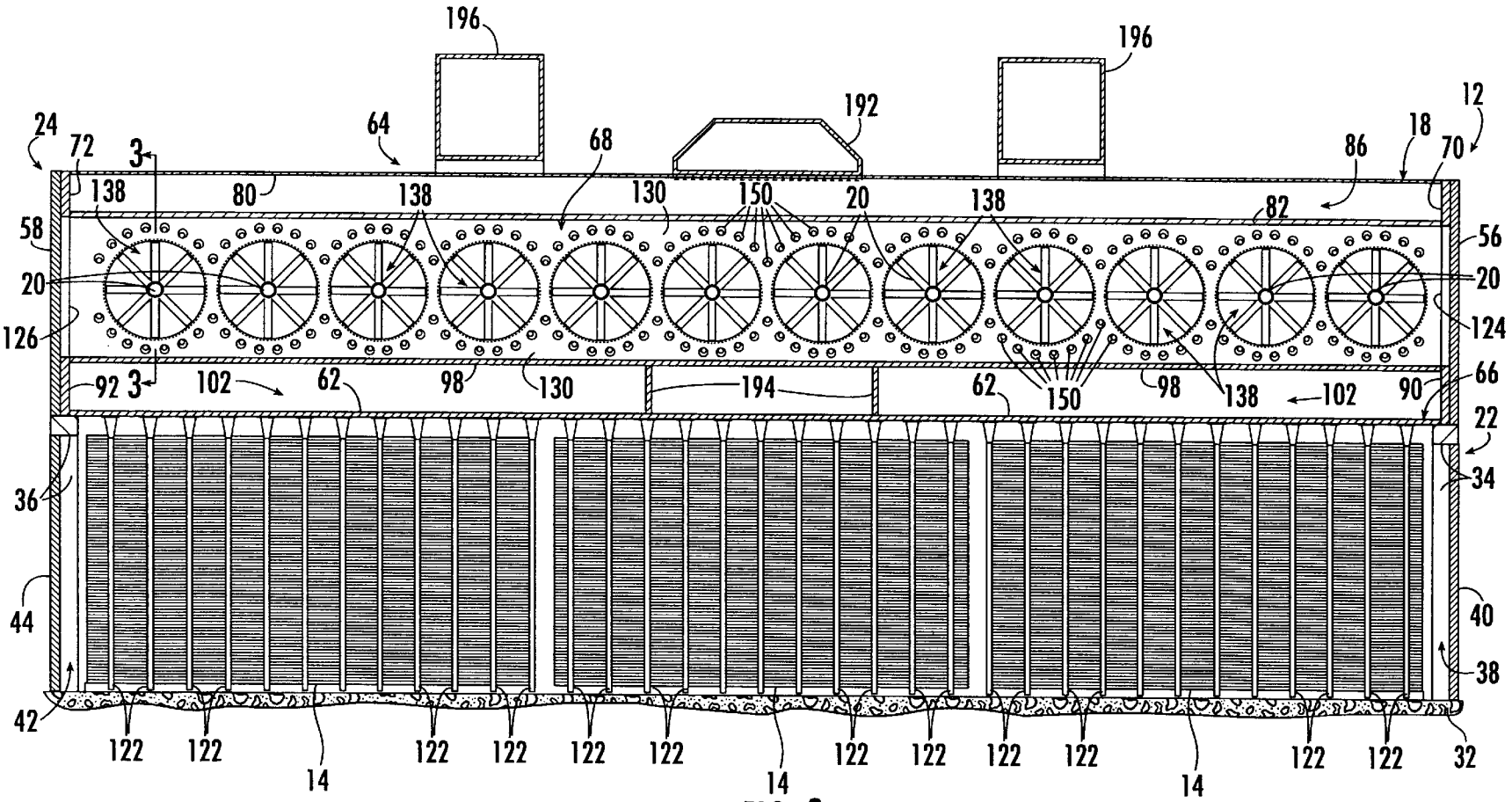
FIG. 2 is a schematic, left side, cross-sectional view of a kiln chamber of the kiln of FIG. 1, wherein the view includes some of the items closely connected to or contained by the kiln chamber, and the cross-section is substantially along line 2—2 of FIG. 1.

The kiln 10 includes a kiln chamber 12 that receives a charge 14 of lumber. The kiln 10 further includes a furnace, such as a suspension furnace 16, or the like, and a communication system that routes heated air from the furnace to the kiln chamber 12 to dry the charge 14 of lumber. The communication system includes a plenum that can be characterized as a composite plenum 18 and a duct system 19 that communicates at least between the furnace 16 and the composite plenum. The kiln chamber 12 and some of the items closely connected to or contained by the kiln chamber are schematically illustrated in FIG. 2, which is a cross-sectional view taken substantially along line 2—2 of FIG. 1. Multiple air moving devices, such as a series of fans 20, are operated to circulate the heated air within the kiln chamber 12 and enhance the drying of the charge 14 of lumber. Only a few of the fans 20 are specifically identified by their reference numeral in FIG. 2.

Structures of the Kiln

As best understood with reference to FIGS. 1 and 2, the kiln chamber 12 includes opposite front and rear ends 22, 24 and opposite right and left sides 26, 28. The kiln chamber 12 defines a chamber interior space that receives the charge 14 of lumber and is heated by the furnace 16. The kiln chamber 12 includes a lower chamber portion that defines a lower portion of the chamber interior space 30, which can also be characterized as a lower chamber interior space. The lower chamber portion includes a slab 32 and load-bearing front and rear walls 34, 36 that extend generally vertically upward from and are carried by the slab. The front wall 34 defines a front door opening 38 therethrough and carries front doors 40, typically in a pivotal or slideable fashion, that are used to open and close the front door opening. Similarly, the rear wall 36 defines a rear door opening 42 therethrough and carries rear doors 44, also typically in a pivotal or slideable fashion, that that are used to open and close the rear door opening. The lower chamber portion further includes lower portions of right and left side walls 46, 48. It should be apparent, however, that the lumber can be loaded and unloaded through the same set of doors such that only one of the front and rear walls includes doors, or alternatively the doors could be in one or both side walls, if so desired.

A transportation system is provided for moving a charge 14 of lumber into the lower portion of the chamber interior space 30, such as through the front door opening 38, for drying, and thereafter out of the lower portion of the chamber interior space, such as through the rear door opening 42. As illustrated in FIG. 1, the transportation system includes two sets of tracks 50 upon which wheeled carriages 52 travel. The tracks 50 extend longitudinally across the slab 32 and through the lower portion of the chamber interior space 30, the front door opening 38, and the rear door opening 42. Each wheeled carriage 52 carries a stack of lumber. The transportation system at least partially defines a charge-receiving space within the lower portion of the chamber interior space 30. The charge-receiving space is the space that is occupied by the charge 14 of lumber in FIGS. 1 and 2. A distance "d1" is defined between each of the right and left side walls 46, 48 and the charge-receiving space. In accordance with one particular example, the distances "d1" are each preferably at least approximately 12.75 feet.

As is additionally illustrated in FIG. 1, the right and left stacks of lumber, which can be characterized as respectively occupying and defining a right stack-receiving space and a left stack-receiving space, are generally spaced apart, such as by a distance "d3". In accordance with one particular example, the distance "d3" is approximately 4.5 feet. In accordance with one particular example, each of the right and left stack-receiving spaces defines a volume of approximately 5,341.25 cubic feet, such that the total volume of the lumber load is approximately 10,682.5 cubic feet.

In accordance with the illustrated embodiment of the present invention, a charge 14 includes six stacks of lumber. However, the kiln 10 is scaleable and in accordance with one embodiment of the present invention a smaller kiln is provided for which a charge includes a single stack of lumber. That is, kilns of various sizes are within the scope of the present invention. For example, kilns that are sufficiently small can include only a single fan and corresponding reduced numbers of other components of the illustrated embodiment.

The kiln chamber 12 also includes an upper chamber portion that is positioned above the lower chamber portion. The upper chamber portion defines an upper portion of the chamber interior space 54, which can also be characterized as an upper chamber interior space. The upper portion of the chamber interior space 54 is positioned above the lower portion of the chamber interior space 30 and at least partially contains the composite plenum 18. The upper chamber portion includes upper portions of the right and left side walls 46, 48, an upper front wall 56, an upper rear wall 58, and a roof 60. The boundary between the upper and lower chamber portions is not necessarily associated with a precise location, but rather the upper and lower chamber portions are described to provide a frame of reference that aids in the description of the kiln chamber 12. Nonetheless, in accordance with the illustrated embodiment of the present invention, a generally horizontally extending lower wall 62 of the composite plenum 18 can be characterized as defining the boundary between the upper and lower portions of the chamber interior space 54, 30.

The composite plenum 18 includes opposite front and rear ends respectively positioned at the front and rear ends 22, 24 of the kiln chamber. The composite plenum 18 extends in a longitudinal direction between its front and rear ends. The front and rear ends of the lower wall 62 of the composite plenum 18 are respectively positioned upon the load-bearing front and rear walls 34, 36. The front and rear walls 34, 36 together bear the entire weight of the composite plenum 18 and the components carried by the composite plenum, in accordance with the illustrated embodiment of the present invention.

The composite plenum 18 is described herein as including an upper plenum 64, a lower plenum 66, and an intermediate plenum 68, each of which can be characterized as being a distinct part or section of the composite plenum. It is within the scope of the present invention for the composite plenum 18 to be characterized as being a non-composite component. Nonetheless, for the sake of explanation is useful to identify the sum of the upper, lower, and intermediate plenums 64, 66, 68 as the composite plenum or as a plenum system, or the like.

The upper plenum 64 includes generally vertically extending, opposite front and rear walls 70, 72, as well as upper and lower right walls 74, 76 that cooperate to define a deck-like right protrusion 78 that extends longitudinally between the front and rear walls of the upper plenum. Likewise, upper and lower left walls 80, 82 cooperate to define a deck-like left protrusion 84 that extends longitudinally between the front and rear walls 70, 72 of the upper plenum 64. All of the walls 70, 72, 74, 76, 80, 82 of the upper plenum 64 at least partially bound and define an upper plenum cavity 86. For example, the upper plenum cavity 86 extends into the right and left protrusions 78, 84 of the upper plenum 64. Walls of the upper plenum 64 also define a longitudinally and horizontally extending, downward-oriented interplenum opening 88 that is open to the upper plenum cavity 86 and is illustrated by broken lines in FIG. 3. The upper plenum cavity 86 and the downward-oriented interplenum opening 88 extend generally for the entire longitudinal length of the upper plenum 64. The upper plenum 64, including the upper plenum cavity 86 and the downward-oriented interplenum opening 88, is generally uniform along the length of the upper plenum (that is, in the longitudinal direction). The upper plenum cavity 86 can contain one or more longitudinally extending baffle plates (not shown) that are operative to restrict any undesired flow characteristics of the heated air within the upper plenum 64.

The lower plenum 66 includes generally vertically extending, opposite front and rear walls 90, 92. The lower wall 62 that generally separates the lower and upper portions of the chamber interior space 30, 54 is part of the lower plenum 66 and extends longitudinally between the front and rear walls 90, 92 of the lower plenum. The lower plenum 66 further includes a right wall 94 that cooperates with the lower wall 62 to provide a front deck-like right protrusion 96 that extends longitudinally between the front and rear walls 90, 92 of the lower plenum. Likewise, a left wall 98 cooperates with the lower wall 62 to provide a deck-like left protrusion 100 that extends longitudinally between the front and rear walls 90, 92 of the lower plenum 66. In an end elevation view the composite plenum 18 generally defines an I-like shape due to the protrusions 78, 84, 96, 100.

All of the walls 62, 90, 92, 94, 98 of the lower plenum 66 at least partially bound and define a lower plenum cavity 102. For example, the lower plenum cavity 102 extends into the right and left protrusions 96, 100. The right wall 94 defines a right radius of curvature 104, and the left wall 98 defines a left radius of curvature 106. Walls of the lower plenum 66 also define a longitudinally and horizontally extending, upward-oriented interplenum opening 180 that is open to the lower plenum cavity 102 and is illustrated by broken lines in FIG. 3. The lower plenum cavity 102 and the upward-oriented interplenum opening 108 extend generally for the entire longitudinal length of the lower plenum 66. Further, the lower plenum 66, including the lower plenum cavity 102 and upward-oriented interplenum opening 108, is generally uniform along the longitudinal length of the lower plenum. The lower plenum cavity 102 can contain one or more longitudinally extending baffle plates (not shown) that are operative to restrict any undesired flow characteristics of the heated air within the lower plenum 66.

The lower wall 62 of the lower plenum 66 includes longitudinally extending right and left edges 110, 112 that extend longitudinally between the front and rear walls 90, 92 of the lower plenum. The right and left edges 110, 112 are spaced apart from one another in a lateral direction that is generally perpendicular to the longitudinal direction. The right edge 110 of the lower wall 62 extends laterally beyond a right side 114 of the charge-receiving space by a distance "d2". Likewise, the left edge 112 of the lower wall 62 extends laterally beyond a left side 116 of the charge-receiving space by a distance "d2". The distances "d2" are each preferably at least approximately one foot. A longitudinally extending right flange 118 is connected to the lower wall 62 proximate the right edge 110. The right flange 118 hangs downward from the lower wall 62 and is generally concave when viewed from the charge-receiving space. Similarly, a longitudinally extending left flange 120 is connected to the lower wall 62 proximate the left edge 112. The left flange 120 hangs downward from the lower wall 62 and is generally concave when viewed from the charge-receiving space. As shown in FIG. 1, the lower plenum 66 is typically larger than the upper plenum 64 since the lower plenum also serves to direct air about the upper right and left comers of the charge 14 of lumber, as will be discussed in greater detail below. However, the upper and lower plenums 64, 66 can have the same general size, if so desired.

As illustrated in FIGS. 1–2, multiple lower outlets, which are preferably in the form of reheater conduits 122, are mounted to the lower wall 62 of the lower plenum 66. Only a representative few of the reheater conduits 122 are identified by their reference numeral in FIG. 2. The reheater conduits 122 direct heated air from the lower plenum cavity 102 to the lower portion of the chamber interior space 30. Each reheater conduit 122 defines a series of vertically spaced apart apertures along its length that provide communication paths to the lower portion of the chamber interior space 30, as will be discussed in greater detail below. As best understood with reference to FIG. 1, the reheater conduits 122 are typically centered between the right and left stack-receiving spaces; however, the reheater conduits can be disposed in other positions if so desired. The reheater conduits 122 will be described in greater detail below, with reference to FIGS. 11–17.

Figure 3:
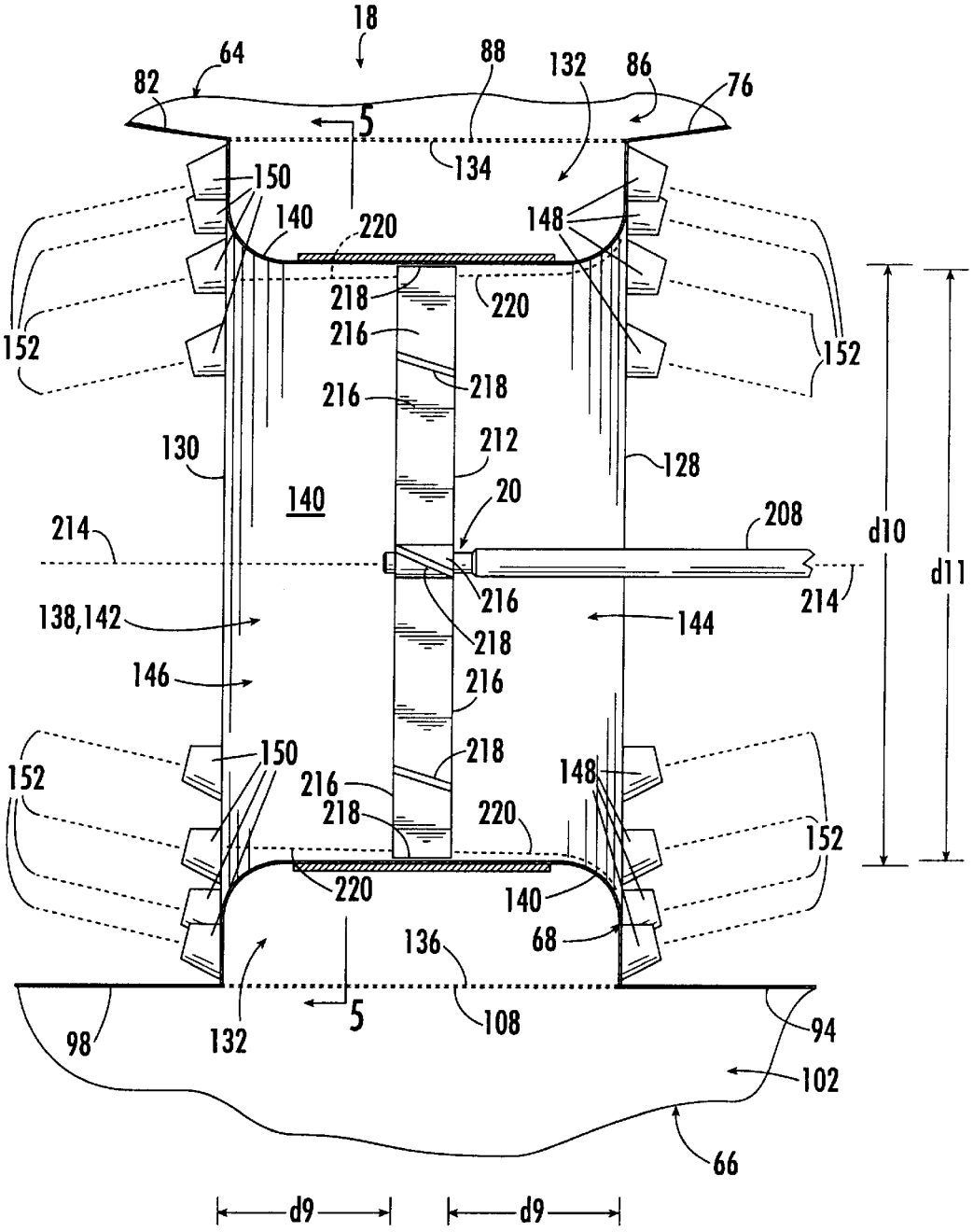
FIG. 3 is a schematic, partial, cross-sectional view taken substantially along line 3—3 of FIG. 2, and illustrating portions of the kiln of FIG. 1, including portions of a composite plenum, a portion of a representative circulation passage extending through an intermediate plenum of the composite plenum, a portion of a representative fan, and representative nozzles-like outlets associated with the composite plenum.

The intermediate plenum 68 includes generally vertically extending, opposite front and rear walls 124, 126. The intermediate plenum 68 also includes generally vertically and longitudinally extending, opposite right and left walls 128, 130 that are laterally spaced apart from one another and extend between the front and rear walls 124, 126. All of the walls 124, 126, 128, 130 of the intermediate plenum 68 at least partially bound and define an intermediate plenum cavity 132 (FIG. 3). Walls of the intermediate plenum also define horizontally and longitudinally extending upward-oriented and downward-oriented interplenum openings 134, 136, both of which are illustrated by broken lines in FIG. 3. The intermediate plenum cavity 132 and the interplenum openings 134, 136 extend generally for the entire longitudinal length of the intermediate plenum 68. The interplenum openings 134, 136 are generally uniform along the length of the intermediate plenum 68. In contrast, the intermediate plenum 68 varies in the longitudinal direction because the intermediate plenum 68 includes a series of generally cylindrical circulation passages 138, which are discussed in greater detail below.

As best understood with reference to FIG. 3, the upward-oriented and downward-oriented interplenum openings 134, 136 of the intermediate plenum 68 are respectively contiguous with and open to the upward-oriented interplenum opening 108 of the lower plenum 66 and the downward-oriented interplenum opening 88 of the upper plenum 64. As a result, the intermediate plenum cavity 132 is contiguous with and in direct communication with both the upper plenum cavity 86 and the lower plenum cavity 102 so that the plenum cavities 86, 102, 132 together constitute a single large interior space of the composite plenum 18, and in accordance with one particular example that single large interior space has a volume of approximately 10,877 cubic feet.

As best understood with reference to FIG. 2, the circulation passages 138 of the intermediate plenum 68 are arranged in a horizontal row. Each of the circulation passages 138 extends generally laterally and horizontally through the intermediate plenum 68. Only a few of the circulation passages 138 are identified by their reference numeral in FIG. 2. A representative one of the circulation passages 138 will now be described with reference to FIG. 3, which is a partial, cross-sectional view taken substantially along the line 3—3 of FIG. 2. The circulation passage 138 includes an interior wall 140 extending around and defining an interior space 142 of the circulation passage, as well as defining opposite right and left openings 144, 146 to the circulation passage. The interior wall 140 isolates the interior space 142 of the circulation passage 138 from the intermediate cavity 132 defined within the intermediate plenum 68. That is, the interior space 142 of the circulation passage 138 is discontiguous with the intermediate cavity 132. Therefore, the circulation passage 138 does not function as an outlet from the intermediate cavity 132. In contrast, the interior space 142 of the circulation passage 138 is in direct communication with/open to the upper portion of the chamber interior space 54 (FIG. 1) by way of the right and left openings 144, 146 of the circulation passage. The medial portion of the interior wall 140 that is between and distant from the right and left openings 144, 146 to the circulation passage 138 is cylindrical, and at the opposite ends of that cylindrical portion the interior wall tapers by forming larger and larger circles that are coaxial with the cylindrical portion. In addition to the foregoing, the interior wall 140 can be characterized as a fan shroud.

As illustrated in FIGS. 1–3, multiple right and left outlets, which are preferably in the form of right and left nozzles 148, 150 but are not required to be nozzle-like, are respectively mounted to the right and left walls 128, 130 of the intermediate plenum 68. Only a few of the nozzles 148, 150 are specifically identified with their reference numerals in FIG. 1, and only a few of the left nozzles 150 are specifically identified with their reference numeral in FIG. 2. All of the right and left nozzles 148, 150 are capable of providing a communication path between the intermediate cavity 132 and the upper portion of the chamber interior space 54 (FIG. 1). The arrangement and operation of the left nozzles 150 on the left wall 130 of the intermediate plenum 68 is representative of the arrangement and operation of the right nozzles 148 on the right wall 128 of the intermediate plenum. As illustrated in FIG. 2, respective upper and lower groups of the left nozzles 150 are arranged partially around the left opening 146 (FIG. 3) of each of the circulation passages 138. Likewise, respective upper and lower groups of right nozzles 148 are arranged partially around the right opening 144 (FIG. 3) of each of the circulation passages 138.

Figure 4:
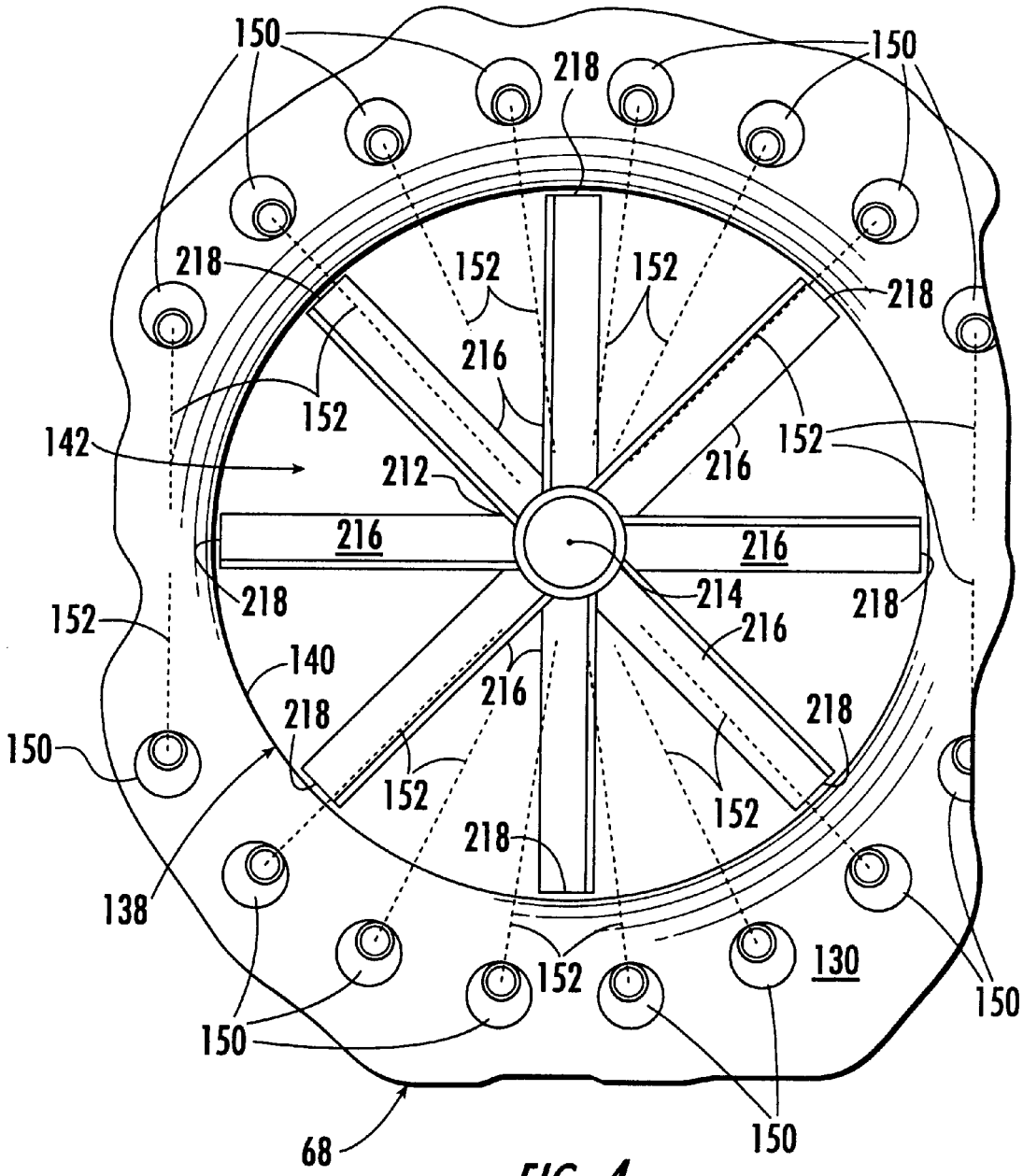
FIG. 4 is a left elevation view of the circulation passage and fan illustrated in FIG. 3, and FIG. 4 also illustrates a portion of the intermediate plenum and some of the nozzle-like outlets carried by the intermediate plenum.

Representative groups of the nozzles 148, 150 will now be described with reference to FIG. 3 and FIG. 4, which is an isolated left elevation view of a section of the intermediate plenum 68 that includes the circulation passage 138 illustrated in FIG. 3. Heated air within the intermediate plenum cavity 132 is capable of flowing into the upper portion of the chamber interior space 54 through the nozzles 148, 150. It is within the scope of the present invention for the nozzles 148, 150 to be neither converging nor diverging. However, in accordance with the illustrated embodiment, each of the nozzles 148, 150 is preferably a converging nozzle, meaning that the interior diameter of the nozzle decreases in the direction of flow therethrough. As a result of the design of the kiln 10, a jet-like flow of heated air is discharged from the nozzles 148, 150 that are open while the kiln is operated. In accordance with one acceptable example, the jet-like flow from each of the nozzles 148, 150 that is open is a flow of heated air with a circular cross section and a velocity of the order of 200 feet per second. During operation of the kiln 10, the jet-like flow is approximately steady and of steady state. Accordingly, each nozzle 148, 150 can be characterized as defining a discharge axis 152 that generally dictates the direction in which the heated air discharged therefrom initially travels. Discharge axes are illustrated by broken lines in FIGS. 3–4.

Different arrangements can be utilized for opening and closing the nozzles 148, 150. For example, one arrangement will be described with reference to FIG. 5. Another example of an arrangement for opening and closing the nozzles 148, 150 will be subsequently described with reference to FIGS. 6–8, in accordance with an alternative embodiment of the present invention.

Figure 5:
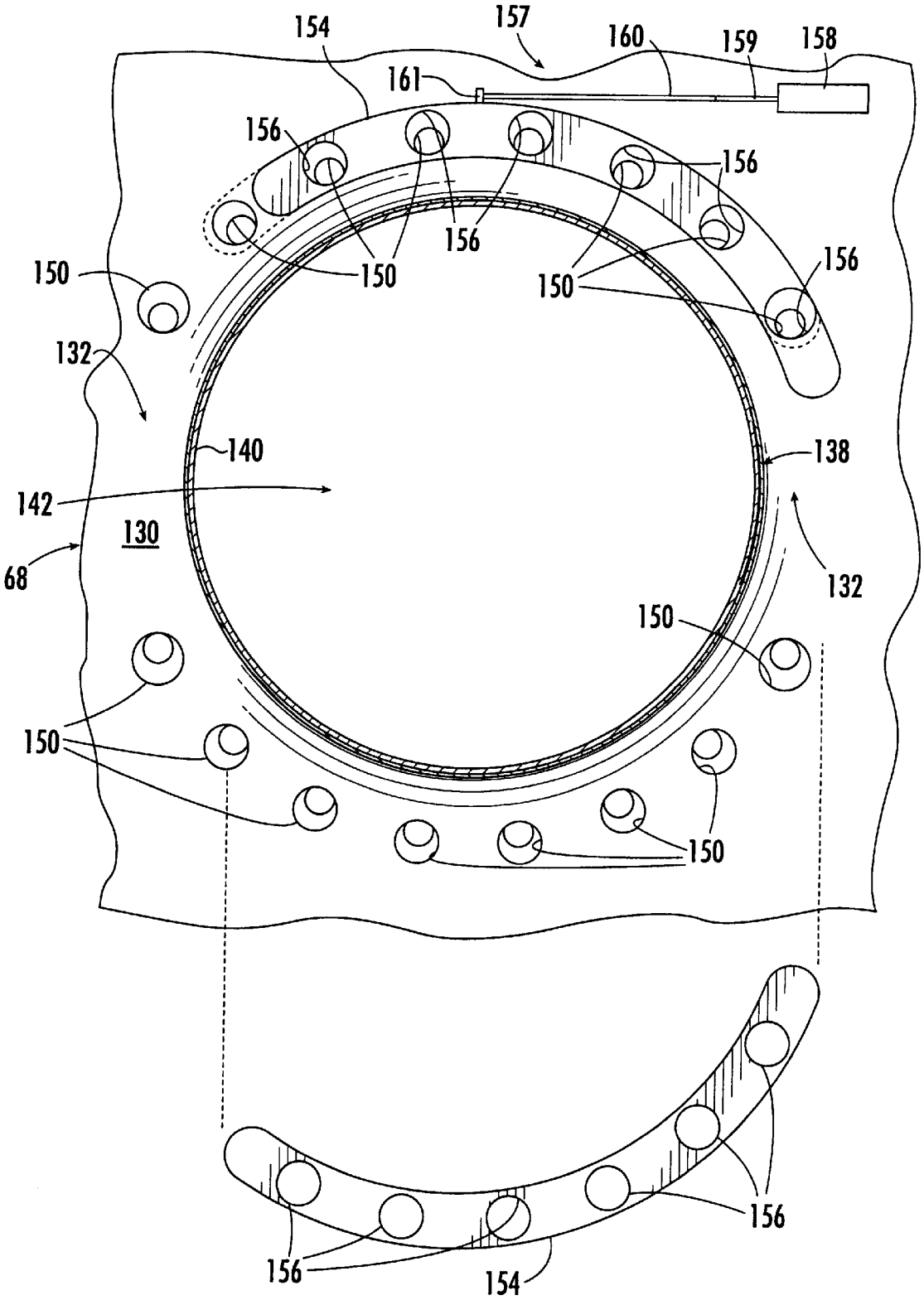
FIG. 5 is a partial and partially exploded schematic view taken along line 5—5 of FIG. 3.

In accordance with one embodiment of the present invention, each of upper groups of right nozzles 148, lower groups of right nozzles, upper groups of left nozzles 150, and lower groups of left nozzles are respectively equipped with nozzle dampers 154 (FIG. 5) positioned in the intermediate plenum cavity 132 and operative for opening and closing the nozzles. Representative upper and lower nozzle dampers 154 will now be described with reference to FIG. 5, although other types of dampers can be employed. The nozzle dampers 154 illustrated in FIG. 5 are carried by the inside surface of the portion of left wall 130 of the intermediate plenum 68 that includes the representative circulation passage 138 and left nozzles 150 illustrated FIG. 4. The nozzle dampers 154 illustrated in FIG. 5 are representative of the other nozzle dampers carried by the inside surface of the left wall 130 of the intermediate plenum 68. Likewise, the nozzle dampers 154 illustrated in FIG. 5 are representative of the nozzle dampers carried by the inside surface of the right wall 128 of the intermediate plenum 68.

The lower nozzle damper 150 illustrated in FIG. 5, which is representative of the upper nozzle damper illustrated in FIG. 5 except for orientation, is exploded away from its respective group of nozzles. Each nozzle damper 150 is arcuate in shape and includes openings 156 spaced along the length thereof, and those openings are sized and spaced in a manner corresponding to the sizing and spacing of the respective nozzles that are opened and closed by the nozzle damper. Brackets or bolting systems (not shown) movably hold the nozzle dampers 154 to the inside surface of the left wall 130 of the intermediate plenum 68.

The operation of the upper nozzle damper 154 illustrated in FIG. 5 and the operation of a damper control system 157 illustrated in FIG. 5 are respectively representative of the operation of the other nozzle dampers and other damper control systems of the kiln 10 (FIG. 1). The upper nozzle damper 154 is illustrated in its open position by solid lines in FIG. 5. In contrast, the upper nozzle damper 154 is illustrated in its closed position by broken lines in FIG. 5. The nozzles 150 associated with the upper nozzle damper 154 are open while the upper nozzle damper is in the open configuration because those nozzles are respectively aligned with and communicating through the openings 156 of the nozzle damper. The nozzles 150 associated with the upper nozzle damper 154 are occluded by solid portions of the upper nozzle damper while the upper nozzle damper is in the closed configuration.

In accordance with the illustrated embodiment of the present invention, movement of the upper nozzle damper 154 between the open and closed configurations is facilitated by the damper control system 157. The damper control system 157 includes a cylinder 158 that is mounted to be stationary and includes a movable push rod 159. The push rod 159 is connected to and moves a control rod 160 that is connected to a clevis 161 that is mounted to the upper nozzle damper 154. As a result, the cylinder 158 can be operated to move the upper nozzle damper 154 between its open and closed configurations. Multiple nozzle dampers 154 can be linked together through the use of additional control rods that are linked together and operated in unison by a single damper control system 157.

The left-most nozzles 150 illustrated in FIG. 5 are not opened and closed by the dampers 154 illustrated in FIG. 5. Rather, there are dampers 154 operative for opening and closing nozzles 150 extending around the circulation passage 138 adjacent to the circulation passage illustrated in FIG. 5. The dampers 154 for that adjacent circulation passage 138 are respectively operative for opening and closing the left-most nozzles 150 illustrated in FIG. 5.

The mounting of the nozzles 148, 150 and the opening and closing thereof will now be described with reference to FIGS. 6–8, in accordance with an alternative embodiment of the present invention that is identical to the embodiment described with reference to FIGS. 1–5, except for variations noted and variations that will be apparent to those of ordinary skill in the art. Only portions of the alternative kiln are illustrated in FIGS. 6–8, and it is to be understood that it is preferred for those representative portions illustrated in FIGS. 6–8 to be duplicated to provide a kiln like that disclosed with respect to FIGS. 1–5, except for the respective substitution of the components illustrated in FIGS. 6–8.

Figure 6:
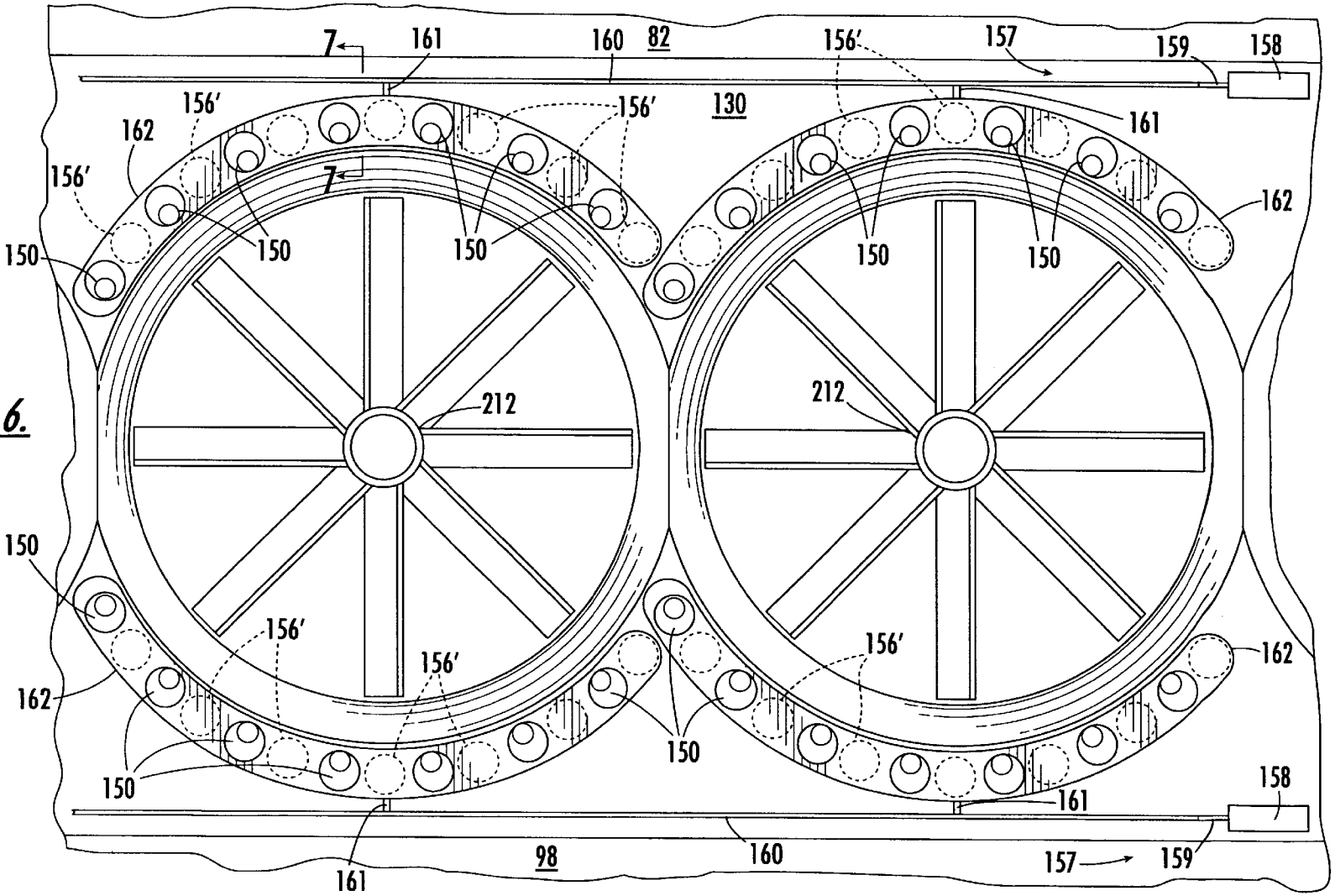
FIG. 6 is a schematic, partial, left elevation view of a portion of the composite plenum and two fans, and FIG. 6 further schematically and representatively illustrates nozzles that are carried by support plates, and holes in dampers that are moved by a damper control system to open and close the nozzles, in accordance with an alternative embodiment of the present invention.
Figure 7:
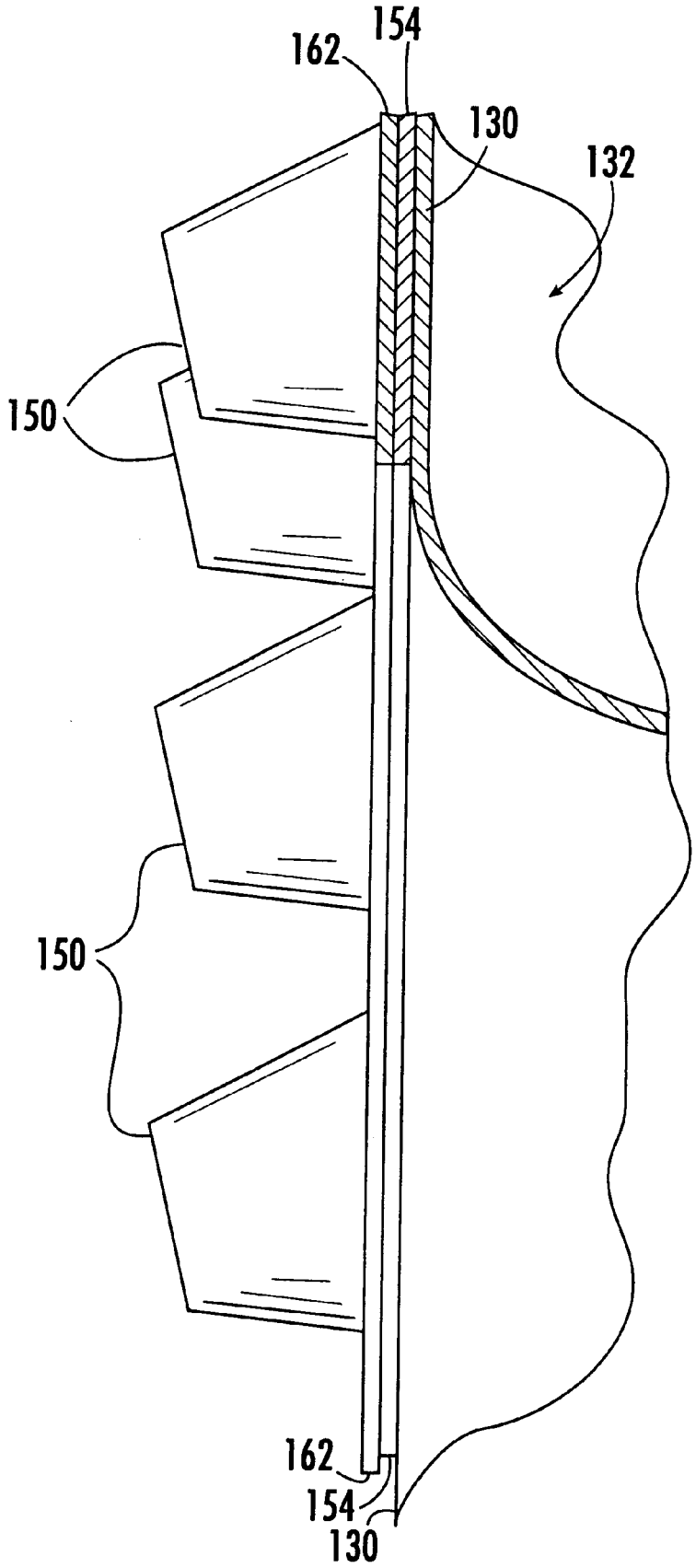
FIG. 7 is a schematic, partial, cross-sectional view taken along line 7—7 of FIG. 6, in accordance with the embodiment illustrated in FIG. 6.
Figure 8:
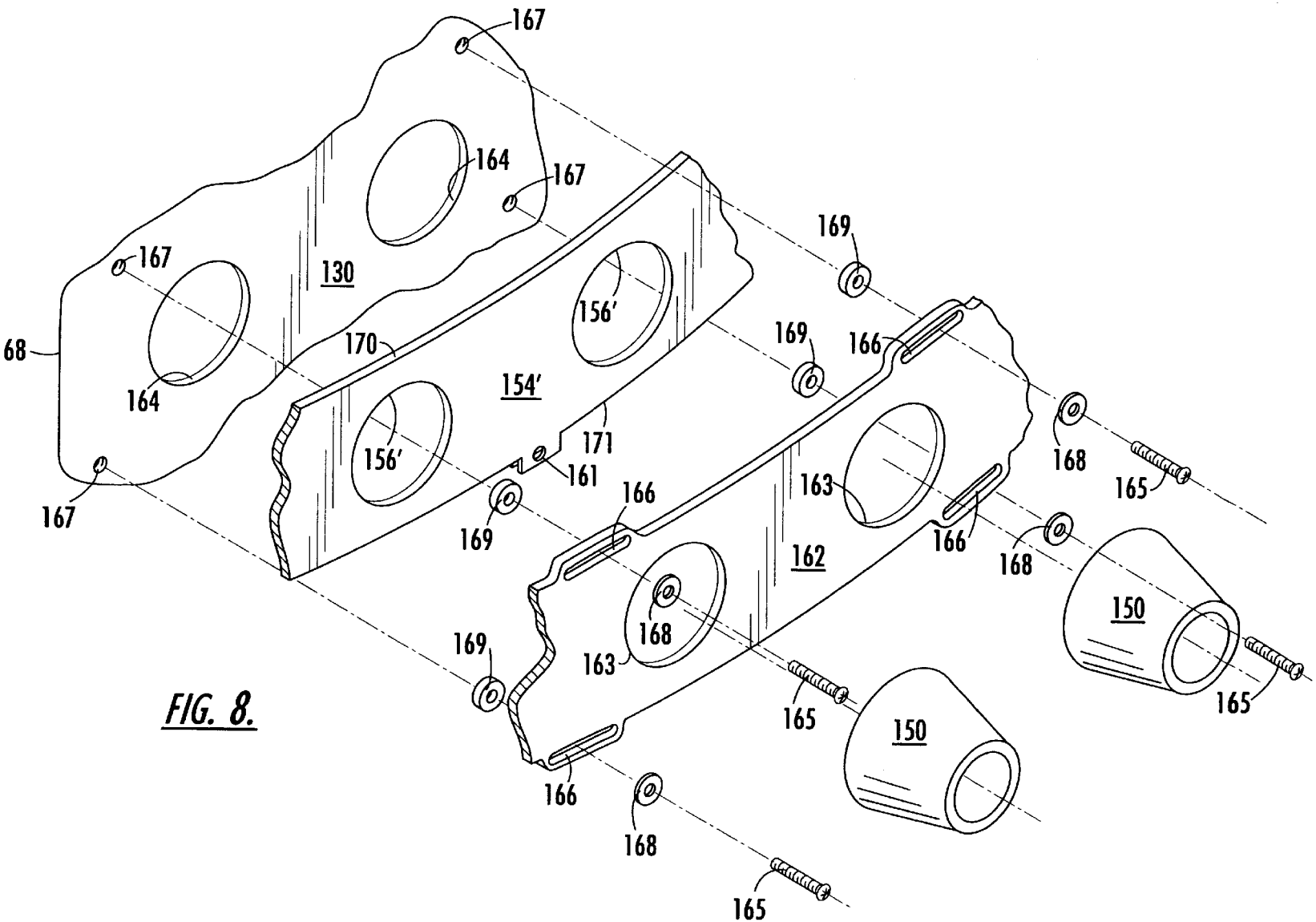
FIG. 8 is a schematic exploded view of representative portions of a left wall of the intermediate plenum of the composite plenum of FIG. 6, a damper, a support plate, and associated attachment means, and a pair of representative nozzles, in accordance with the embodiment illustrated in FIGS. 6–7.

In accordance with the embodiment illustrated in FIGS. 6–8, the mounting of the left nozzles 150 and the arrangement and operation of their associated arcuate nozzle dampers 154' (FIG. 8) and damper control systems 157 (FIG. 6) are representative of the mounting of the right nozzles 148 and the arrangement and operation of the nozzle dampers and damper control systems associated with the right nozzles. In accordance with the embodiment illustrated in FIGS. 6–8, the nozzles 150 are mounted, such as through the use of welding techniques or the like, to outside surfaces of respective arcuate support plates 162. Only a representative few of the nozzles 150 are specifically identified by their reference numeral in FIG. 6. The nozzles 150 are positioned to be coaxial with respective downstream openings 163 (FIG. 8) that are defined through the support plates 162. The support plates 162 are mounted so that inside surfaces of the support plates are oriented toward the outside surface of the left wall 130 of the intermediate plenum 68. The left wall 130 defines a plurality of upstream openings 164 (FIG. 8) therethrough that are open to the intermediate plenum cavity 134 (FIGS. 3 and 7). The support plates 162 are mounted so that the downstream openings 163 therethrough are capable of being generally coaxial with respective upstream openings 164.

More specifically, and as best understood with reference to the exploded and representative nozzles 150 and portions of the left wall 130, damper 154', support plate 162, and associated components illustrated in FIG. 8, each support plate is mounted to the left wall 130 by multiple bolts 165. Referring to the representative components, or portions thereof, illustrated in FIG. 8, the support plate defines multiple slots 166, and bolts 165 respectively extend through the slots. Each bolt 165 includes a threaded shaft that terminates at a head, and the threaded shafts are threaded into respective threaded bores 167 defined by the left wall 130.

Referring to a representative one of the bolts 165 illustrated in FIG. 8, the shaft of the bolt receives a cylindrical washer 168 prior to the shaft being inserted through its respective slot 166. The shaft of the bolt 165 receives a cylindrical bushing 169 after the shaft has been passed through its washer 168 and slot 166, and prior to the shaft being threaded into its respective threaded bore 167. Each of the washers 168 and bushings 168 has a major diameter that is sufficiently large to prevent the washers and bushings from passing through the respective slots 166 while assembled as described above. Accordingly, the support plate 162 is mounted to the left wall 130 by the bolts 165 and spaced apart from the left wall 130 by the bushings 168. For example, the spacing of a support plate 162 with respect to the wall 130 is illustrated in FIG. 7.

Further referring to the representative components, or portions thereof, illustrated in FIG. 8, a nozzle damper 154' is positioned in the space between the support plate 162 and the left wall 130. An inner edge 170 of the nozzle damper 154' engages and is selectively movable relative to inner ones of the bushing 169 (that is, the upper bushings illustrated in FIG. 8). Likewise an outer edge 171 of the nozzle damper 154' engages and is selectively moveable relative to outer ones of the bushings 169 (that is, the lower bushings illustrated in FIG. 8). The nozzle damper 154' defines multiple intermediate openings 156' therethrough and the nozzle damper is moveable between open and closed configurations. In the open configuration, the intermediate openings 156' are generally respectively aligned with upstream openings 164, downstream openings 163, and nozzles 150, as is generally illustrated in FIG. 8, so that heated air is supplied through the nozzles. In contrast and as illustrated in FIG. 6, in the closed configuration the intermediate openings 156', which are illustrated by broken lines in FIG. 6, are offset from upstream openings 164, downstream openings 163, and nozzles 150 so that heated air is not supplied through the nozzles. Only a representative few of the intermediate openings 156' are specifically identified by their reference numeral in FIG. 6.

In accordance with the embodiment illustrated in FIGS. 6–8, movement of the nozzle dampers 154' between the open and closed configurations is facilitated by the damper control systems 157 (FIG. 6). As best understood with reference to FIG. 6, each damper control system 157 includes a cylinder 158 that is mounted to be stationary and includes a movable push rod 159. The push rod 159 is connected to and moves one or more control rods 160 that are respectively connected to devises 161 that are respectively mounted to the dampers 154'. As a result, the cylinder 158 can be operated to move multiple nozzle dampers 154' between their open and closed configurations.

Further referring to the representative components, or portions thereof, illustrated in FIG. 8, the amount of flow through the nozzles 150 while the damper 154' is in its open configuration can be adjusted by adjusting the alignment of the nozzles with the with upstream and intermediate openings 164, 156'. The alignment can be adjusted by loosening the bolts 165 so that the support plate 162 is movable relative to the wall 130. Thereafter, the support plate 162, which remains supported by the bolts 165, is manually moved the desired amount so that the bolts are positioned differently in their respective slots 166. Thereafter, the bolts 165 are tightened to secure the support plate 162 in its new position. This procedure can be used to increase or decrease the alignment between the nozzles 150 with their respective upstream and intermediate openings 164, 156' so that the flow through the nozzles is respectively increased or decreased.

As best understood with reference to FIG. 1, in accordance with another alternative embodiment that is not illustrated, the nozzles 148, 150 are connected to the upper and lower plenums 64, 66 rather than being connected to the intermediate plenum 68. More specifically, the upper right nozzles 148 are mounted to the lower right wall 76 of the upper plenum 64 and are capable of providing a communication path between the upper plenum cavity 86 (FIG. 3) and the upper portion of the chamber interior space 54. Similarly, the upper left nozzles 150 are mounted to the lower left wall 82 of the upper plenum 64 and are capable of providing a communication path between the upper plenum cavity 86 and the upper portion of the chamber interior space 54. Further, the lower right nozzles 148 are mounted to the right wall 94 of the lower plenum 66 and are capable of providing a communication path between the lower plenum cavity 102 (FIG. 3) and the lower portion of the chamber interior space 30. Similarly, the lower left nozzles 150 are mounted to the left wall 98 of the lower plenum 66 and are capable of providing a communication path between the lower plenum cavity 102 and the lower portion of the chamber interior space 30. In accordance with this alternative embodiment, the components for opening and closing the nozzles 148, 150 are relocated accordingly.

The suspension furnace 16 of the illustrated embodiment of the present invention is diagrammatically illustrated in FIG. 1. The furnace 16 includes a mixing chamber 174 in which combustible fuel is burned to create fire 176. The fire 176 creates combustion by-products that are mixed with heated air. The furnace 16 includes an air moving device 178 that moves the heated air and associated combustion by-products. Accordingly, for the portions of the Detailed Description of the Invention section of this disclosure that describe the embodiment of the present invention that is illustrated in FIGS. 1–6, "heated air" refers to the combination of the air heated by the furnace 16 and the combustion by-products carried by that heated air. In accordance with another embodiment of the present invention, the furnace 16 includes a heat exchanger and is operated so that the air heated by the furnace is substantially absent of the combustion by-products created by the fire 176. Further, it is within the scope of the present invention for the furnace 16 to be of any type that is conventionally used to provide heated air to a plenum that distributes the heated air.

The duct system 19 that extends from the furnace 16 is schematically illustrated in FIG. 1 as including a hot duct assembly 180 and a cool duct assembly 182. The hot duct assembly 180 directs heated air from the furnace 16 to the composite plenum 18. The hot duct assembly 180 includes an upstream duct 184 having an upstream end connected to and in direct communication with the furnace 16, and a bifurcated downstream end connected to and in communication with both an upper downstream duct 186 and a lower downstream duct 188. An adjustable damper 190 is positioned within the upstream duct 184 at the juncture with the downstream ducts 186, 188 for balancing or adjusting the flows into the downstream ducts. The upper downstream duct includes an outlet end 192 (also see FIG. 2) that is mounted to the upper plenum 64 and is in direct communication with the upper plenum cavity 86. The lower downstream duct 188 includes an outlet end 194 (also see FIG. 2) that is mounted to the lower plenum 66 and is in direct communication with the lower plenum cavity 102.

The cool duct assembly 182 directs air from the upper portion of the chamber interior space 54 to the furnace 16. The cool duct 182 assembly includes a pair of right return ducts 196 (also see FIG. 2) and a pair of left return ducts 198 (only one of which is shown) having upstream ends mounted to the roof 60 and capable of being in direct communication with the upper portion of the chamber interior space 54.

Different arrangements can be utilized for opening and closing the return ducts 196, 198. For example, one arrangement will be described with reference to FIG. 1. Another example of an arrangement for opening and closing the return ducts 196', 198' will be described with reference to FIG. 9, in accordance with an alternative embodiment of the present invention.

In accordance with the embodiment illustrated in FIG. 1, each of the right return ducts 196 is equipped with a respective right return damper 200 (only one of which is shown) that is capable of being moved to open and close the duct. Likewise, each of the left return ducts 198 is equipped with a respective left return damper 202 (only one of which is shown) that is capable of being moved to open and close the duct. The right return damper 200 illustrated in FIG. 1 is positioned so that the right return duct 196 illustrated in FIG. 1 is open to the upper portion of the chamber interior space 54. In contrast, the left return damper 202 illustrated in FIG. 1 is positioned so that the left return duct 198 illustrated in FIG. 1 is isolated from the upper portion of the chamber interior space 54.

The opening and closing of return ducts 196', 198' will now be described with reference to FIG. 9, in accordance with an alternative embodiment of the present invention that is identical to the embodiment described with reference to FIGS. 1–5, except for variations noted and variations that will be apparent to those of ordinary skill in the art. In accordance with this alternative embodiment, one of the right return ducts 196' joins one of the left return ducts 198' and a downstream duct 193 to form a tee. There are preferably two separate tees (that is, two separate right return ducts 196', two separate left return ducts 198', and two downstream ducts 193) and associated components. Whereas only a single tee is illustrated in FIG. 9, the illustrated tee and its associated components are representative of the corresponding yet not illustrated tee and its associated components.

Figure 9:
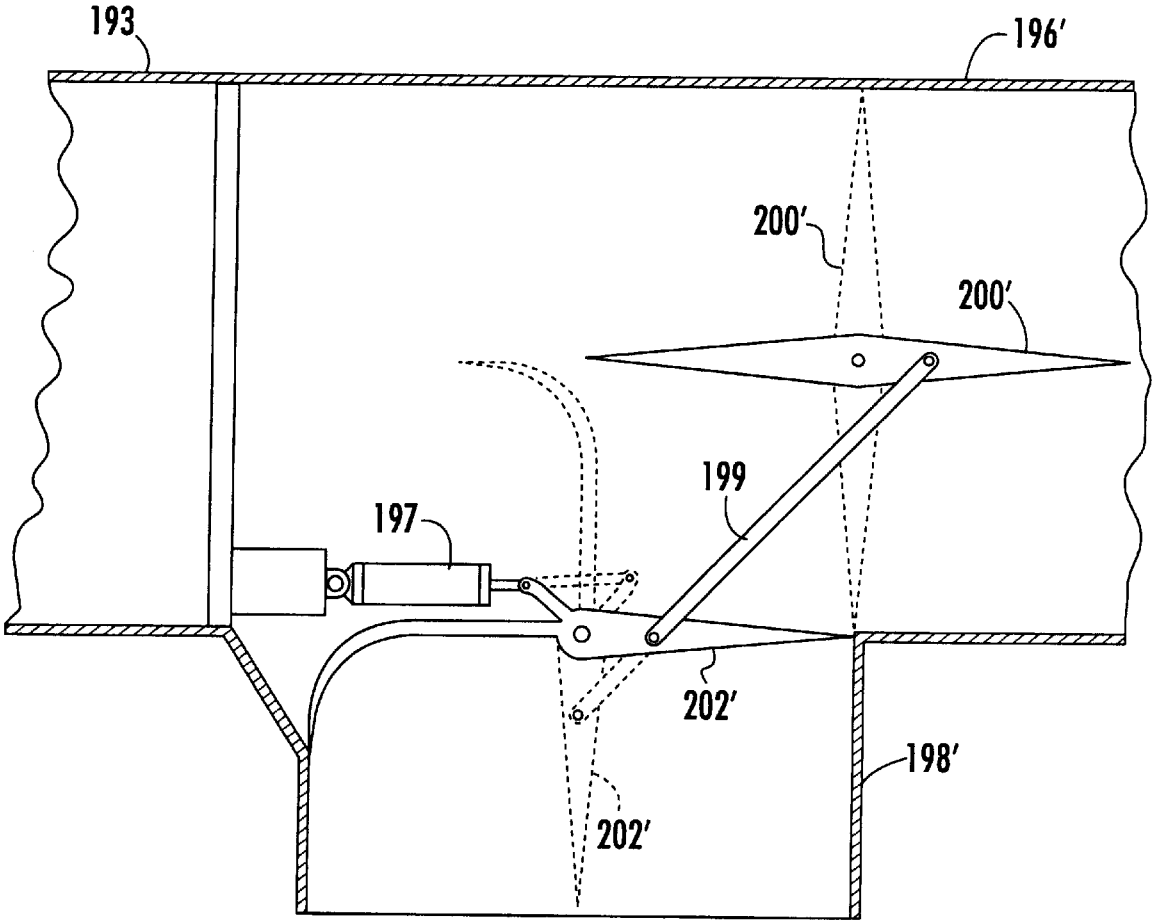
FIG. 9 is a schematic, partial, and side sectional view of a representative tee formed by return ducts, and FIG. 9 schematically illustrates a damper system within the tee in both open and closed configurations, in accordance with an alternative embodiment of the present invention.

Referring to the representative components illustrated in FIG. 9, the downstream duct 193 provides the communication path from the right and left return ducts 196', 198' to the mixing chamber 174 (FIG. 1). As illustrated in FIG. 9, the right return damper 200' is positioned in the right return duct 196' at the tee. Similarly, the left return damper 202' is positioned in the left return duct 198' at the tee. Each of the dampers 200', 202' are respectively centrally pivotally mounted and moveable between the positions indicated by solid and broken lines in FIG. 9. In addition, a linkage 199 is connected between and links the dampers 200', 202', and a piston assembly 197 is mounted within the tee and connected to the left return damper 202'. The piston assembly 197 is operated and the linkage 199 is operative so that the dampers 200', 202' move together between the positions illustrated by solid lines and the positions illustrated by broken lines in FIG. 9. Accordingly, the right return duct 196' is in communication with and the left return duct 198' is not in communication with the mixing chamber 174 via the downstream duct 193 while the dampers 200', 202' are in the positions illustrated by solid lines in FIG. 9. In contrast, the right return duct 196' is not in communication with and the left return duct 198' is in communication with the mixing chamber 174 via the downstream duct 193 while the dampers 200', 202' are in the positions illustrated by broken lines in FIG. 9.

As best understood with reference to FIG. 2, air moving devices, which are fans 20 in accordance with the illustrated embodiment of the present invention, are positioned within the upper portion of the chamber interior space 54 in a parallel arrangement that extends in the longitudinal direction. The fans 20 are capable of providing a recirculating flow path 204 within the upper and lower portions of the chamber interior space 54, 30. The general center of the recirculating flow path 204 is schematically illustrated in FIG. 1 by a line made up of a series of two short dashes alternating with one dash. The fans 20 are reversible and can be operated so that all of the air within the upper and lower portions of the chamber interior space 54, 30 moves either in a clockwise direction along the recirculating flow path 204 or a counterclockwise direction along the recirculating flow path. Throughout the Detailed Description of the Invention section of this disclosure, FIG. 1 is the frame of reference with respect to which flow in the clockwise and counterclockwise directions is defined. The direction of operation of the fans 20 is periodically reversed during the drying of a charge 14 of lumber because reversing the flow helps to uniformly dry the charge of lumber.

As shown in FIG. 2, each of the circulation passages 138 is equipped with a respective fan 20. Only a few of the fans 20 are identified by their reference numeral in FIG. 2. A representative one of the fans 20 will now be described with reference to FIG. 1, in which a portion of the representative fan is hidden from view and therefore shown in broken lines. The fan 20 includes a motor 206 that rotates a drive shaft 208 by way of a drive belt 210. An impeller 212 is mounted to the end of the drive shaft 208 and is positioned within the respective circulation passage 138. Portions of a representative one of the fans 20 will now be described with reference to FIG. 3. The motor 206 and drive belt 210 are not shown and the drive shaft 208 is partially cut away in FIG. 3. Whereas FIG. 3 is a cross-sectional view taken substantially along line 3—3 of FIG. 2, the impeller 212 and drive shaft 208 are not cross-sectioned in FIG. 3. The fan 20, or more specifically the impeller 212, has a rotational axis 214 that dictates the general direction in which the air moved by the fan initially travels. The interior wall 140 of the respective circulation passage 138 extends around and is coaxial with the rotational axis 214. The impeller 212 includes multiple blades 216 that extend radially away from proximate the rotational axis 214 of the impeller, and each blade includes a blade tip 218 that is distant from the rotational axis. As best understood with reference to FIG. 2, the rotational axes (for example see the rotational axis 214 illustrated in FIG. 3) of all of the impellers 212 are parallel and extend in a common horizontal plane.

A representative one of the reheater conduits 122 will now be described with reference to FIG. 1, in accordance with one embodiment of the present invention. The reheater conduit 122 includes opposite top and bottom ends. More specifically, the top end of the reheater conduit 122 is in the form of an contraction fitting 222, and the lower end of the reheater conduit 122 is in the form of a pipe-like structure 224 connected to and extending downward from the contraction fitting. The interior of the pipe-like structure 224 is open to the interior of the contraction fitting 222. The pipe-like structure 224 is closed at its bottom end and includes a normally closed ash dump door 226 at its bottom end. In accordance with the illustrated embodiment of the present invention, ash is carried by the heated air supplied from the furnace 16 into the composite plenum 18, and at least some of the ash settles into the bottom end of the pipe-like structure 224. The ash dump door 226 is periodically opened while the kiln 10 is not operating so that ash can be removed from the pipe-like structure 224, and thereafter the ash dump door is closed and remains closed during normal operation of the kiln.

Figure 11:
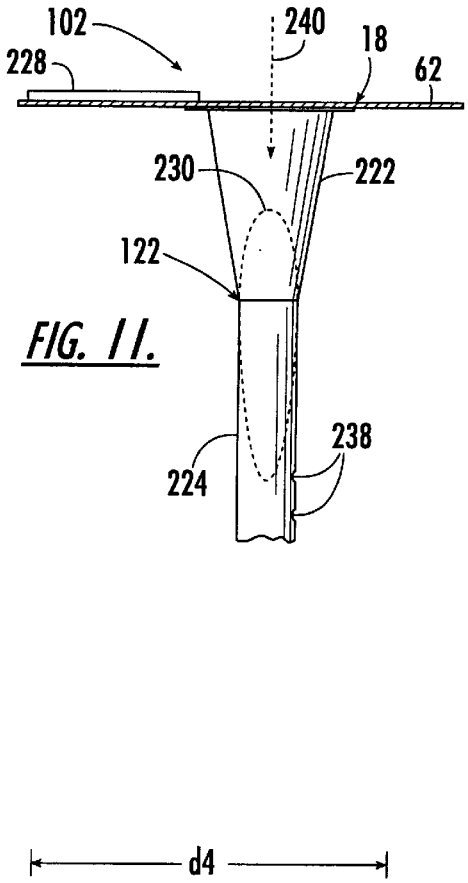
FIG. 11 is a schematic right elevation view of a portion of a representative reheater conduit of the kiln of FIG. 1, a portion of a lower wall of the composite plenum to which the reheater conduit is attached, and a damper for throttling flow into the reheater conduit.

A representative one of the reheater conduits 122 and an associated representative portion of the lower wall 62 of the composite plenum 18 will now be described with reference to FIG. 11, in accordance with one embodiment of the present invention. Whereas the reheater conduits 122 are described as being used in combination with the composite plenum 18, the reheater conduits can be used in combination with a variety of different types of plenums, or the like. The top end of the contraction fitting 222 is mounted to the bottom surface of the lower wall 62 of the composite plenum 18. The lower wall 62 of the composite plenum 18 defines an opening therethrough that is contiguous with an upper opening of the contraction fitting 222 so that the interior of the pipe-like structure 224 is in communication with the lower plenum cavity 102 via the contraction fitting. The communication path between the interior of the pipe-like structure 224 and the lower plenum cavity 102 can be opened and closed, or throttled, by manually operating a movable damper 228 that is held to the interior surface of the lower wall 62 by brackets (not shown). Each of the reheater conduits 122 is respectively equipped with a separate movable damper 228 so that each of the reheater conduits can be separately throttled.

Figure 12:
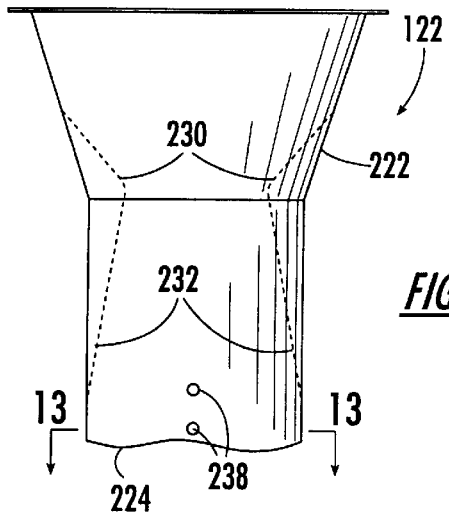
FIG. 12 is an isolated, schematic front elevation view of a portion of the reheater conduit of FIG. 11.

A representative one of the reheater conduits 122 will now be described with reference to FIGS. 11–12, in accordance with one embodiment of the present invention. Adjacent internal portions of the contraction fitting 222 and the pipe-like structure 224 cooperate to define a contraction expansion that is shaped to advantageously offset or balance the effects of partially closing the inlet to the reheater conduit 122 with the respective damper 228. More specifically, the contraction expansion includes an internal contraction 230 and an internal expansion 232, both of which are illustrated by broken lines in FIGS. 11–12. The internal contraction 230 accelerates the flow into the contraction expansion to remove separation that may exist as the flow enters the reheater conduit 122 from the lower plenum 66. In accordance with the illustrated embodiment, the internal contraction 230 is shorter than the internal expansion 232. The internal expansion 232 is more gradual than the internal contraction 230 and functions to decelerate the flow therethrough to the predetermined lower velocity that is desired in the pipe-like structure 224. The deceleration provided by the internal expansion 232 is gradual so as to avoid separation. In accordance with one embodiment of the present invention, the internal contraction 230 has a length of approximately 6 inches, the internal expansion 232 has a length of approximately 18 inches, the angle defined by the internal contraction 230 relative to the vertical is not critical, and the angle defined by the internal expansion 232 relative to the vertical is of the order of approximately 8 to 15 degrees.

Figure 13:
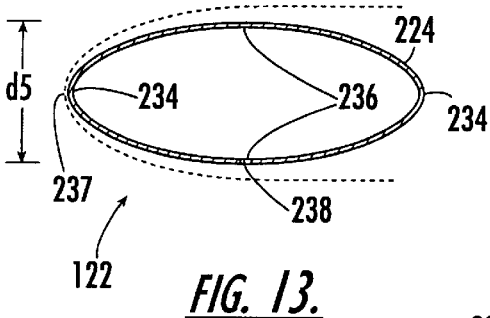
FIG. 13 is a cross-sectional view of the portion of the reheater conduit of FIG. 12 taken along line 13—13 of FIG. 12.

A representative one of the pipe-like structures will now be described with reference to FIG. 13, which is a cross-sectional view taken along line 13—13 of FIG. 12, in accordance with one embodiment of the present invention. As illustrated in FIG. 13, the pipe-like structure 224 is preferably elliptical, or the like, although other shapes are also within the scope of the present invention, such as oblong shapes, and the like. More specifically, the pipe-like structure 224 is elliptical in a cross-section thereof taken perpendicular to the length thereof. The pipe-like structure 224 can be characterized as including a pair of major vertices 234 that define a major cross-dimension "d4" therebetween. Further, the pipe-like structure can be characterized as including a pair of minor vertices 236 defining a minor cross-dimension "d5" therebetween. The major cross-dimension "d4" is preferably at least two times greater than the minor cross-dimension "d5". More specifically, in accordance with one specific example of the present invention, the major cross-dimension "d4" is in the range of approximately 10 inches to approximately 18 inches, and most preferably approximately 14.6 inches; and the minor cross-dimension "d5" is in the range of approximately 5 inches to approximately 12 inches, and is most preferably approximately 7.6 inches. In accordance with another specific example, the major cross-dimension "d4" is approximately 18 inches and the minor cross-dimension "d5" is approximately 9 inches.

Each of the reheater conduits 122 extends into the recirculating flow path 204 (FIG. 1). As a result, and as best understood with reference to FIG. 13, for each reheater 122 a flow-induced boundary layer 237 is formed generally therearound while the fans 20 (FIGS. 1–3) are operated to cause air to flow along the recirculating flow path 204. A representative boundary layer 237 resulting from counter-clockwise flow along the recirculating flow path 204, from the frame of reference provided by FIG. 1, is illustrated by broken lines in FIG. 13. Of course the orientation of the boundary layers 237 would be opposite from that illustrated for clockwise flow along the recirculating flow path 204. As illustrated in FIG. 13, downstream portions of the boundary layers 237 can become separated from the trailing surfaces of the reheater conduits 122.

As best understood with reference to FIGS. 11–14, each pipe-like structure 224 includes multiple outlets 238 spaced along its length from close to its top end to close to its bottom end. The outlets 238 are preferably closer to the minor vertices 236 than to the major vertices 234, and most preferably the outlets are arranged along the minor vertices 236. For each reheater conduit 122, heated air within the lower plenum cavity 102 is capable of flowing along a flow path 240 (FIG. 11) into the reheater conduit, and out of reheater conduit and into the recirculating flow path 204 by way of outlets 238.

Each of the outlets 238 is constructed to provide jet-like flow. More specifically, and as best understood with reference to FIG. 13, each outlet is preferably in the form of a cylindrical bore that extends through the wall of the respective pipe-like structure 224 to provide communication from the flow path 240 to the recirculating flow path 204 (FIG. 1). In accordance with the illustrated embodiment of the present invention, each outlet 238 has a length that extends in the direction of flow through the outlet, and the length is equal to the thickness of the wall of the pipe-like structure 224; and each outlet has a diameter that is perpendicular to the direction of flow through the outlet, and the diameter is in the range of approximately 0.25 inches to approximately 6 inches, and is most preferably approximately 0.625 inches. Whereas the outlet 238 are described above and below as being generally cylindrical in shape, it is within the scope of the present invention for them to be shaped differently. In accordance with one acceptable example, the jet-like flow from each of the outlets 238 is a flow of heated air with a circular cross section and a velocity of the order of 200 feet per second. During operation of the kiln 10 the jet-like flow is approximately steady and of steady state.

Figure 14:
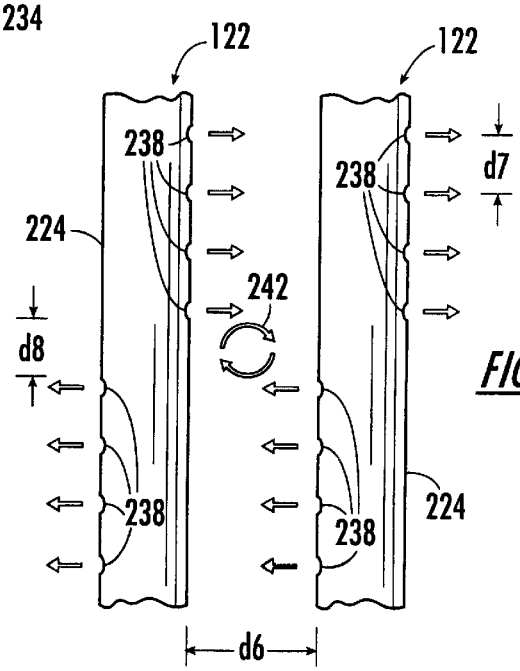
FIG. 14 is a schematic right elevation view of portions of a representative pair of adjacent reheater conduits of the kiln of FIG. 1, illustrating heated air being discharged therefrom.

FIG. 14 is a schematic right elevation view of sections of a representative pair of adjacent reheater conduits 122 in accordance with one embodiment of the present invention. FIG. 14 illustrates heated air being discharged from the outlets 238 of the reheater conduits 122. In FIG. 14, the jet-like flow being discharged by the outlets are represented by straight arrows. The interaction between the representative pair of adjacent reheater conduits 122 illustrated in FIG. 14 will now be described. The outlets 238 are arranged in groups, and the groups are staggered such that the jet-like flows from the adjacent reheater conduits cooperate to form eddy-like whirling masses of air 242, which can also be characterized as vortices. The pattern of the outlets 238 illustrated in FIG. 14 repeats numerous times along the lengths of adjacent reheater conduits 122 so that for each pair of adjacent reheater conduits a series of the whirling masses of air 242 are contemporaneously and continuously produced while the kiln 10 is operating. Each of the formed whirling masses of air 242 travels generally along the recirculating flow path 204 (FIG. 1) and results in turbulence that interacts with a stack of lumber that is proximate to and downstream from the reheater conduits 122, as will be discussed in greater detail below. In accordance with the illustrated embodiment of the present invention, the distance "d6" between the adjacent reheater conduits 122 is in the range of approximately 8 inches to approximately 48 inches, and is most preferably approximately 25.5 inches. The center-to-center distance "d7" between adjacent outlets 238 of the same reheater conduit 122 is preferably in the range of approximately 1 inch to approximately 10 inches, and is most preferably approximately 2.74 inches. The center-to-center distance "d8" between the closest outlets 238 of adjacent groups of outlets of adjacent reheater conduits 122 is in the range of approximately 0.25 inches to approximately 30 inches, and is most preferably approximately 2.74 inches.

Whereas each group of adjacent outlets 238 for the same reheater conduit 122 is illustrated as including four outlets in FIG. 14, in accordance with an alternative embodiment (not shown) the reheater conduits are identical to and used identically to the reheater conduits illustrated in FIGS. 11–14, except for variations that are noted and variations that will be apparent to those of ordinary skill in the art. In accordance with this alternative embodiment, each group of adjacent outlets of the same reheater conduit includes two outlets, the center-to-center distance between the closest outlets of adjacent groups of outlets on the same side of the same reheater conduit is approximately 8.23 inches, the outlets begin on one side of the pipe-like structure 224 at a distance of approximately 14.75 inches from the base of the contraction fitting 222, and the outlets begin on the other side of the pipe-like structure at a distance of approximately 20.23 inches from the base of the contraction fitting. In accordance with other embodiments, each group of adjacent outlets 238 of the same reheater conduit includes three outlets or more than four outlets. In accordance with other embodiments, the groups of adjacent outlets 238 are replaced with slots.

Figure 15:
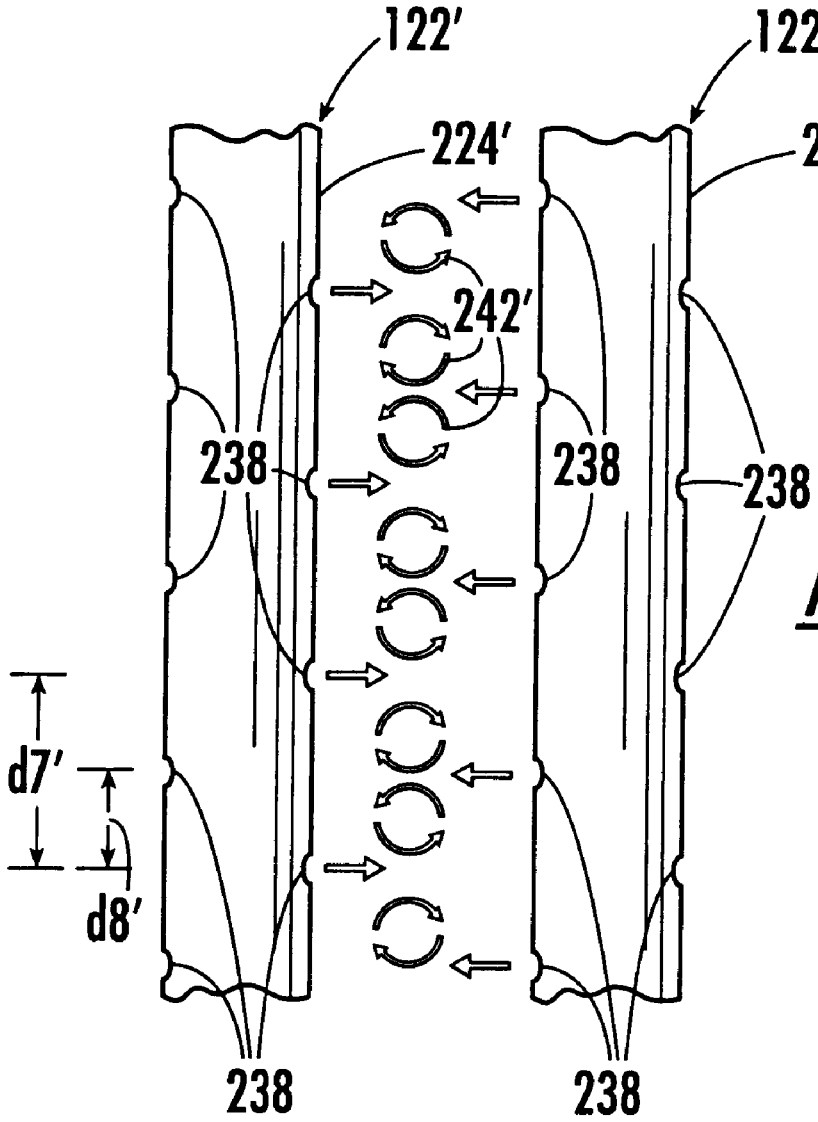
FIG. 15 is a schematic right elevation view of portions of a representative pair of adjacent reheater conduits a kiln, in accordance with an alternative embodiment of the present invention.

FIG. 15 is a schematic right elevation view of a representative pair of adjacent ones of reheater conduits 122', in accordance with an alternative embodiment of the present invention. The reheater conduits 122' of the alternative embodiment are identical to and used identically to the reheater conduits 122 illustrated in FIGS. 11–14, except for variations that are noted and variations that will be apparent to those of ordinary skill in the art. As will be noted, the adjacent reheater conduits included outlets that are staggered such that an outlet from one of the reheater conduits is vertically positioned between, typically in the middle of, a pair of adjacent outlets from the other reheater conduit. As described above in conjunction with the embodiment of FIG. 14, the staggered outlets serve to create whirling masses of air in the recirculating flow path. The center-to-center distance "d7'" between adjacent outlets 238 of the same reheater conduit 122' is preferably approximately in the range of approximately 1.0 inch to approximately 20 inches, and is most preferably approximately 8.23 inches. The center-to-center distance "d8'" between adjacent outlets of adjacent reheater conduits 122 is approximately half of the distance "d7'". That is, the distance "d8'" is in the range of approximately 0.5 inches to approximately 15 inches, and is most preferably approximately 2.74 inches.

As illustrated in both FIGS. 14 and 15, for a given reheater conduit, the outlets on one side thereof are preferably staggered with respect to the outlets on the other side thereof.

Construction of the Kiln

Some of the aspects relating to the efficient construction of the kiln 10 will now be described, in accordance with one embodiment of the present invention. The kiln 10 is preferably at least partially constructed and assembled using modular construction techniques. More specifically, the composite plenum 18 and other components of the kiln 10 are at least partially pre-manufactured remotely from the final construction site of the kiln and are trucked to the final construction site of the kiln.

In accordance with one embodiment of the present invention, the composite plenum 18 is in multiple different and separate pieces when shipped to the final construction site, and those pieces are welded or bolted together, or the like, at the construction site such that in isolation the assembled composite plenum is absent of movable parts. In contrast, in accordance with another embodiment of the present invention, the composite plenum 18 is constructed so that it can originally be transitioned between extended and collapsed configurations by moving (that is, telescoping) the intermediate plenum 68 into and out of the upward-oriented interplenum opening 108 (FIG. 3) of the lower plenum 66. The extended configuration is illustrated by solid lines in FIGS. 1–3 and by the broken line in FIG. 10 that is in the form of alternating short and long dashes. In contrast, the collapsed configuration is illustrated by solid lines and by the broken line that is in the form of uniform dashes in FIG. 10. As illustrated, the upper plenum 64 is mounted to the intermediate plenum 68 during both the compacted and extended configurations. Portions of the protrusions 96, 100 of the lower plenum 66 are cut away in FIG. 10.

Figure 10:
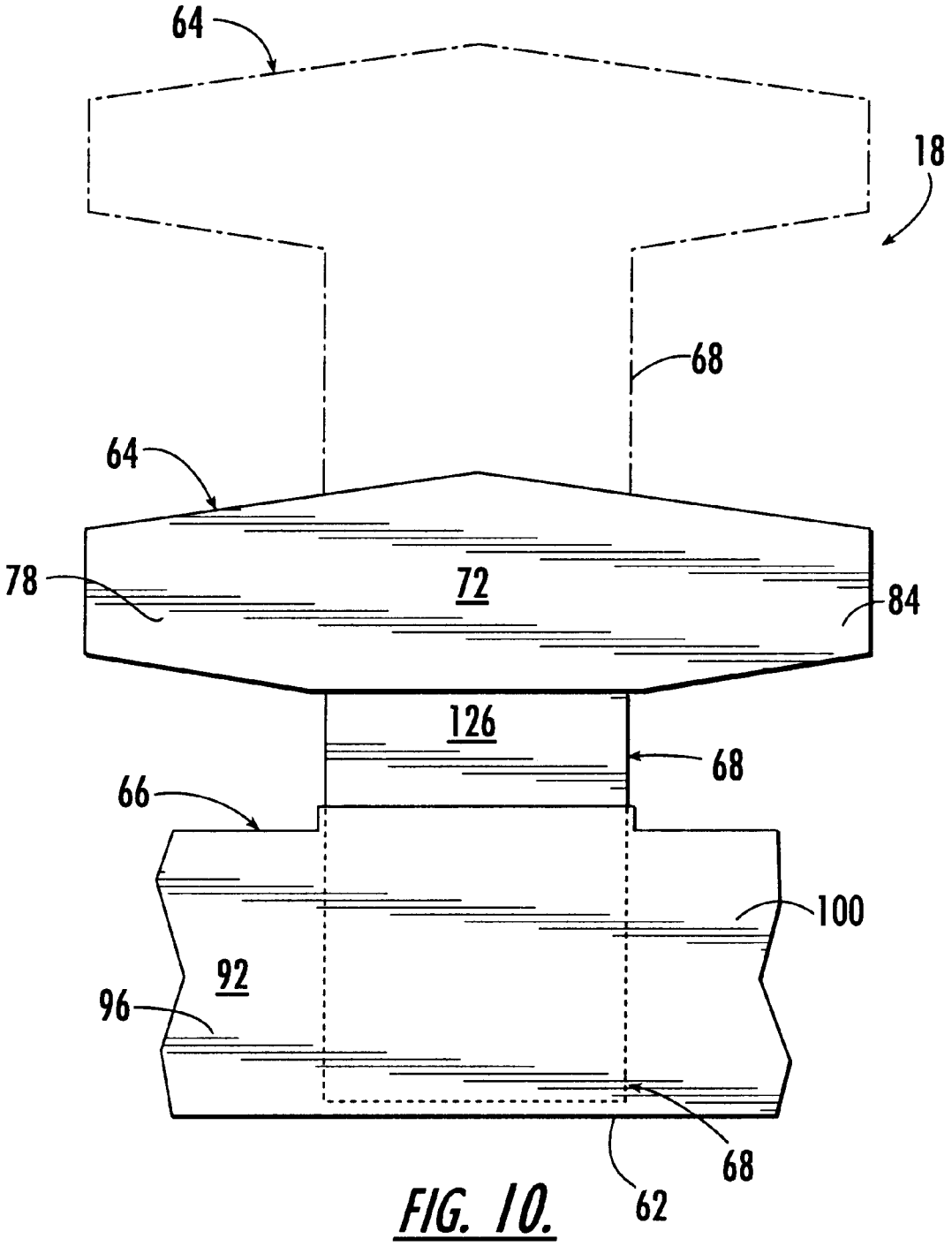
FIG. 10 is an isolated, schematic, rear end elevation view illustrating a telescopic composite plenum that can be used in the kiln of FIG. 1, in accordance with one embodiment of the present invention, wherein the composite plenum is illustrated in both compacted and extended configurations.

Further regarding the telescoping composite plenum 18 and as best understood with reference to FIG. 10, the walls 124, 126, 128, 130 (also see FIGS. 1–5) of the intermediate plenum 68 extend through the upward-oriented interplenum opening 108 (FIG. 3) of the lower plenum 66 and the lower ends of the walls of the intermediate plenum extend into the lower plenum cavity 102 and are proximate the lower wall 62 during the compacted configuration. As a result, the walls 90, 92, 94, 98 (also see FIGS. 1–3) of the lower plenum 66 that extend around and define the upward-oriented interplenum opening 108 of the lower plenum 66 overlap the walls 124, 126, 128, 130 of the intermediate plenum 68, so that those walls of the intermediate plenum can be characterized as underlapping walls. At least lower ones of the nozzles 148, 150 (FIGS. 2–5) are not mounted to the intermediate plenum 68 during the compacted configuration, because at least some of the nozzles would interfere with the telescoping.

The telescoping capability is particularly advantageous when the kiln 10 is constructed and assembled using modular construction techniques. The composite plenum 18 is assembled and placed in the collapsed configuration at a location remote from the final site of the kiln 10 and is thereafter transported to the final site of the kiln, where the composite plenum is placed in the extended configuration. The extended configuration is achieved by telescopically lifting the combination of the upper and intermediate plenums 64, 68 with respect to the lower plenum 66, such as through the use of a crane, or the like. The combination of the upper and intermediate plenums 64, 68 is lifted so that at least substantially less of the intermediate plenum extends into the lower cavity 102 of the lower plenum 66 during the extended configuration than during the compacted configuration. Lower portions of the intermediate plenum 68 are then immovably mounted to the lower plenum 66 to hold the composite plenum 18 in the extended configuration through the use of conventional mounting techniques, such as welding, bolting, or the like. Thereafter, the nozzles 148, 150 are mounted to the intermediate plenum 68 through the use of conventional mounting techniques, such as welding, bolting, or the like.

The slab 32 is poured at the final location of the kiln 10. The load-bearing front and rear walls 34, 36 are positioned generally vertically upon the slab 32 and are spaced apart from one another in the longitudinal direction. Other walls of the kiln chamber 12 may be placed upon the slab 32 along with the load-bearing front and rear walls 34, 36 to stabilize the load-bearing front and rear walls. Thereafter, the composite plenum 18 is lifted, such as through the use of a crane, and the composite plenum is lowered so that the front and rear ends of the bottom wall 62 respectively rest upon the load-bearing front and rear walls 34, 36, as is illustrated in FIG. 2. The composite plenum 18 is secured to the load-bearing front and rear walls 34, 36 through the use of conventional construction techniques, such as welding, or bolting, or the like. Thereafter, the other walls 56, 58 and the roof 60 of the kiln chamber 12 are installed in a generally modular fashion to define the upper and lower portions of the chamber interior space 54, 30. In accordance with the illustrated embodiment, the kiln chamber 12 is constructed so that the composite plenum 18 is suspended above the slab 32 solely by the load-bearing front and rear walls 34, 36. In addition, the roof 60, reheater conduits 122, and at least some of the upper front and rear walls 56, 58 of the kiln chamber are mounted directly to and carried by the composite plenum 18. As such, the composite plenum 18 and the load bearing portions of the front and rear walls 34, 36 are preferably formed of steel in order to support the kiln components carried thereby without additional load bearing structures.

In accordance with another embodiment of the present invention, the kiln 10 is more completely built at the final construction site of the kiln using construction techniques other than modular construction techniques.

Operation of the Kiln

The kiln 10 operates in a manner that efficiently dries a charge 14 of lumber. The basic operation of the kiln 10 will now be described, in accordance with one embodiment of the present invention, with occasional reference to exemplary advantageous aspects of the kiln. Advantageous aspects of the kiln 10 include, but are not limited to, those that promote the uniform drying of the charge 14 of lumber, that reduce flow-related losses within the kiln, that optimize heat utilization within the kiln, that enhance the operation of the fans 20, that enhance the mixing of the heated air within the upper portion of the chamber interior space 54, and that enhance mixing of heated air and efficient flow through the charge of lumber. Although some of the aspects of the kiln 10 are described in the context of a single advantage, those of ordinary skill in the art will appreciate that at least some of the recited advantages are not independent of one another. Further, this disclosure is not intended to provide an exhaustive list of all of the advantages provided by the present invention.

The kiln 10 is readied for operation by using the transportation system, which includes the tracks 50 and wheeled carriages 52, to placing a charge 14 of green lumber within the charge-receiving space by way of the front door opening 38. Thereafter, the front and rear doors 40, 44 are closed to respectively close the front and rear door openings 38, 42. In addition, other openings (not shown) of the kiln chamber 12 are closed so that the interior space of the kiln chamber is generally enclosed. Some leakage of air into and out of the interior space of the kiln chamber 12 is desired, however, so that moisture escapes from the interior space of the kiln chamber and ambient air is drawn into the interior space of the kiln chamber.

After the interior space of the kiln chamber 12 is generally sealed with a charge 14 of green lumber in the charge-receiving space, the furnace 16 is operated so that heated air is supplied to the interior space of the kiln chamber 12 and the fans 20 are operated to move the heated air along the recirculating flow path 204. In accordance with one aspect of the kiln 10, the direction of operation of the fans is periodically reversed while a charge 14 of lumber is being dried, which promotes the uniform drying of the charge of lumber. Each fan 20 is operated in a manner that promotes clockwise flow along the recirculating flow path 204 during a clockwise mode. For each fan 20, the right side thereof is the high-pressure or discharge side and the left side thereof is the low-pressure or intake side during the clockwise mode. Likewise, each fan 20 is operated in a manner that promotes counterclockwise flow along the recirculating flow path 204 during a counterclockwise mode. For each fan 20 the left side thereof is the high-pressure or discharge side and the right side thereof is the low-pressure or intake side during the counterclockwise mode.

The reheater conduits 122 are constructed and operate to provide heated air from the composite plenum 18 to the lower portion of the chamber interior space 30. In addition, the reheater conduits 122 are constructed and operate to reduce flow-related losses associated with the flow along the portion of the recirculating flow path 204 that extends through the lower portion of the chamber interior space 30. For example, for each of the reheater conduits 122 the major cross-dimension "d4" is generally parallel to the portion of the recirculating flow path 204 through which the reheater conduits extend. As a result, the reheater conduits 122 define a relatively "low profile" with respect to flow along the recirculating flow path 204. In addition, outlets of adjacent reheater conduits 122 are arranged to cooperate to produce whirling masses of air 242. The whirling masses of air 242 travel generally along the recirculating flow path 204 and result in turbulence that interacts with a stack of lumber of the charge 14 that is proximate and downstream from the reheater conduits 122. The whirling masses of air 242 form turbulent eddies with a characteristic size determined by the center-to-center distance "d8" between the closest outlets 238 of adjacent groups of outlets of adjacent reheater conduits 122. The turbulence decays in a natural process with time. As the whirling masses of air 242 (i.e., large vortices) decay they form smaller and smaller eddies. The small scale limit is the well known Kolmogorov Microscale, which is familiar to those knowledgeable in the art. During the time in which the vortices move from the reheater conduits 122 to the downstream stack(s) of lumber, the size of the vortices decays to a mean integral length scale of approximately 0.1 to 0.05 inches. The vortices of that size interact with the downstream stack(s) of lumber. Advantageously, this reduces the entrance loss associated with stack(s) of lumber by carrying the momentum into the separated region (discussed below). That is, the eddies interact with the downstream stack(s) of lumber in a manner that causes resistance to flow through the downstream stack(s) of lumber to be less than the resistance to flow through the downstream stack(s) of lumber absent the whirling masses of air 242. This latter aspect of the reheater conduits 122 can best be understood by first understanding the dynamics of how air flows through a stack of lumber, which is described below.

Figure 16:
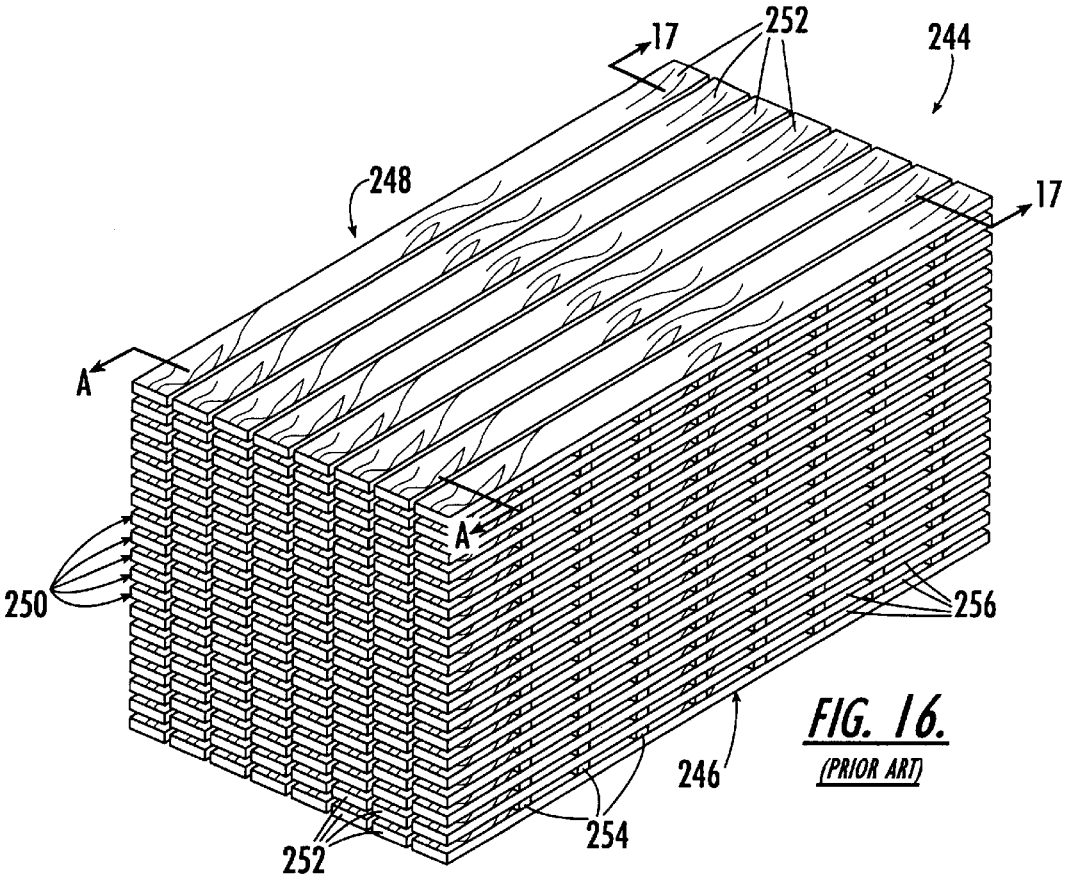
FIG. 16. (PRIOR ART)
FIG. 16 is a perspective view of a conventional stack of lumber that can be dried in a kiln.

FIG. 16 is a perspective view of a conventional stack of lumber 244 that is to be dried in the kiln chamber 12. More specifically, the stack 244 includes a right side 246 and an opposite left side 248, and multiple horizontally extending layers 250 of lumber that are arranged one above the other and extend between the right and left sides. Each layer 250 includes multiple pieces of lumber 252. Multiple stickers or spacers 254, which are typically in the form of narrow pieces of lumber, or the like, are positioned between the layers 250 and extend between the opposite sides 246, 248 so that multiple passages 256 are defined between adjacent layers 250 and are open at the opposite sides. Only a few of the layers 250, pieces of lumber 252, spacers 254, and passages 256 are identified with a reference numeral in FIG. 16. A flow of heated air is forced through each of the passages 256 while the stack is dried by the kiln 10.

Figure 17:
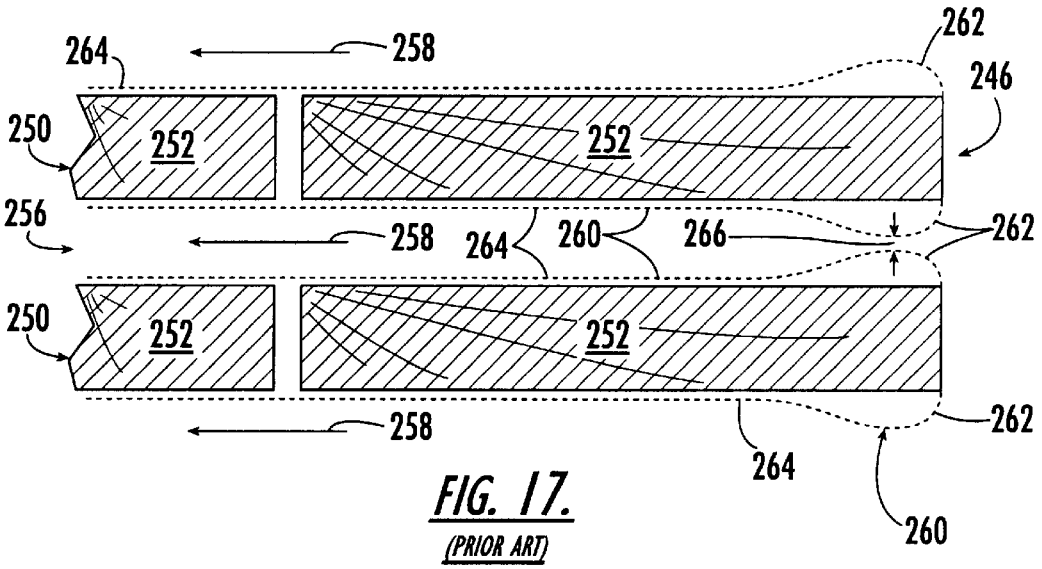
FIG. 17. (PRIOR ART)
FIG. 17 is a cross-sectional view of a portion of the stack of FIG. 12 taken along line 17—17 of FIG. 16, wherein boundary layers resulting from airflow through the stack are diagrammatically shown by dashed lines.

A portion of a representative passage 256 is best seen in FIG. 17, which is a cross-sectional view of a portion of the stack 244 taken along line 17—17 of FIG. 16. FIG. 17 diagrammatically illustrates boundary layers 260 that form while airflow is forced into the passages 256 via openings of the passages that are at the right side 246 of the stack 244. The direction of the airflow is generally designated by the arrows 258 in FIG. 17.

Each of the passages 256 of the stack 244 are generally identical; therefore, the flow into the passage 256 that is illustrated in FIG. 17 is generally representative of the flow into each of the passages 256 via the openings to the passages that are at the right side 246 of the stack 244. Whereas FIG. 17 has been described heretofore as being illustrative of airflow into the passages 256 via openings at the right side 246 of the stack 244, FIG. 17 is also illustrative of airflow into the passages via openings at the left side 248 of the stack, in which case FIG. 17 is a cross-sectional view of a portion of the stack taken along line A—A of FIG. 16.

As best seen in FIG. 17, for each of the passages 256, airflow therethrough is such that viscous layers of air are developed proximate to the surfaces of the pieces of lumber 252 that face and define the passage. Those viscous layers are referred to as boundary layers 260, which are not visible but are generally illustrated by dashed lines in FIG. 17. More specifically, the boundary layers 260, which are areas of retarded flow, are caused by the viscous interaction between the airflow through the passage 256 and the surfaces of the pieces of lumber 252 that define the passage, as well as interaction between the airflow and the lumber surfaces that are proximate to the inlet opening of the passage.

Each boundary layer 260 includes a protruding separated region 262 that tapers to a generally planar tail portion 264. For each of the boundary layers 260, the protruding separated region 262 is a portion of the boundary layer that has become separated from the surface or surfaces of the one or more pieces of lumber 252 that define the passage. The separation occurs because of interaction between the airflow and an edge or edges of the one or more pieces of lumber 252 that define the inlet to the passage.

As illustrated in FIGS. 16–17, it is conventional for the edges of the layers 250 to be aligned so that they extend in a common plane. As a result, for each of the passages 256, the protruding separated regions 262 of the boundary layers 260 are aligned in a manner that is very restrictive to flow, since the boundary layers are regions of retarded flow and thereby tend to block flow into the passage 256. More specifically, an unrestricted flow path exists only in that region between the boundary layers 260 of each of the passages 256. Those unrestricted flow paths are characterized by generally fully developed flow. Within each passage 256, the protruding separated regions 262 are aligned in a manner that causes a significant reduction in the size of the unrestricted flow path, as designated by the arrow 266 in FIG. 17.

In other words, at the entrance to each slot-like passage 256 there is a region of little or no flow moving along the slot-like passage. More specifically, that region is a region of separated flow that can be referred to as a separated region and is indicated by the numeral 262. The separated region 262 is reduced along the length of the slot-like passage 256 and replaced by a shear flow that consists of thin boundary layers which quickly evolve into what is called fully developed flow. Inefficiencies are associated with the separated regions 262 because the separation effectively blocks the flow into the slot-like passage 256 and therefore increases the pressure required to move air through the slot-like passages.

As best understood with reference to FIGS. 1, 14, and 17, turbulence resulting from the whirling masses of air 242 that are respectively created by the reheater conduits 122 travels generally along the recirculating flow path 204 and interacts with the one or more stacks of lumber of the charge 14 that are proximate to and downstream from the reheater conduits. The turbulence resulting from the whirling masses of air 242 interacts with the downstream stack(s) of lumber in a manner that causes resistance to flow through the stack(s) of lumber to be less than the resistance to flow through the stack(s) of lumber absent the whirling masses. As best understood with reference to FIG. 17, the turbulence resulting from the whirling masses of air 242 interferes with the formation of the separated region 262 by impacting the surfaces of the pieces of lumber 252 that are adjacent to the openings of the passage 256 and impacting the protruding separated regions 262 of the boundary layers. Most specifically, the fine grain turbulence that results from the whirling masses of air 242 mixes momentum into the separated regions 262 thus reducing the size of the separation (i.e., reducing the size of the separated regions 262). That is, the turbulence resulting from the whirling masses of air 242, 242' functions to at least increase the size of the unrestricted flow paths that are defined between the peaks of the protruding separated regions 262 and designated by the arrow 266 in FIG. 17.

In addition to reducing flow related losses, the jet-like flow provided by the outlets 238 of the reheater conduits 122 enhances heat utilization within the lower portion of the chamber interior space 30. More specifically, the distance "d6" between adjacent reheater conduits 122 and the characteristics of the jet-like flows from the outlets 238 are selected so that the jet-like flows from of each of the reheater conduits 122 reach and interact with the boundary layer 237 (FIG. 13) around at least one adjacent reheater conduit, so that the boundary layer around the adjacent reheater conduit is smaller than it would be absent the jet-like flows, or more specifically so that the separated regions of the boundary layer associated with the adjacent reheater conduit is smaller than it would be absent the jet-like flows. That is, the jet-like flows from the outlets 238 of the reheater conduits 122 interfere with the formation of and thereby decrease the size of the separated regions of the boundary layers 237 that are proximate the downstream portions of the reheater conduits. As a result, convective heat transfer from the reheater conduits 122 is enhanced, because the separated regions of the boundary layers 237 formed generally around the reheater conduits tend to interfere with convective heat transfer from the reheater conduits.

The furnace 16 is operated so that the air moving device 178 of the furnace moves heated air from the mixing chamber 174 to the composite plenum 18 by way of the hot duct assembly 180. In accordance with another aspect of the kiln 10, the composite plenum 18 is sized and the kiln 10 is designed and operated so that the heated air within the interior space of the composite plenum is at a relatively high pressure and has a relatively low velocity, which reduces flow-related losses within the composite plenum and facilitates the balancing of flow from the composite plenum to the interior space of the kiln chamber 12. More specifically, in accordance with one exemplary embodiment the interior space of the composite plenum 18 has a volume that is at least approximately as large as the total volume of the lumber load (i.e., the volume of the charge of lumber 14), and more specifically the volume of the composite plenum is approximately equal to the total volume of the lumber load, and most specifically the interior space of the composite plenum has a volume of approximately 10,877 cubic feet and the total volume of the lumber load (that is, the sum of the volume of the right and left stack receiving spaces) is approximately 10,682.5 cubic feet.

In accordance with another aspect of the kiln 10, the right radius of curvature 104 defined by the right wall 94 of the lower plenum 66 provides for a smooth transition of the flow along the recirculation flow path 204 from the upper portion of the chamber interior space 54 to the lower portion of the chamber interior space 30 during the clockwise mode, which reduces flow-related losses within the kiln. In addition, the right radius of curvature provides for a smooth transition of the flow along the recirculation flow path 204 from the lower portion of the chamber interior space 30 to the upper portion of the chamber interior space 54 during the counterclockwise mode. Likewise, the left radius of curvature 106 defined by the left wall 98 of the lower plenum 66 provides for a smooth transition of the flow along the recirculation flow path 204 from the upper portion of the chamber interior space 54 to the lower portion of the chamber interior space 30 during the counterclockwise mode. In addition, the left radius of curvature 106 provides for a smooth transition of the flow from the lower portion of the chamber interior space 30 to the upper portion of the chamber interior space 54 during the clockwise mode.

In accordance with another aspect of the kiln 10, the cool duct assembly 182 is operated so the air moving device 178 of the furnace 16 draws only relatively cool air from the interior space of the kiln chamber 12 to the mixing chamber 174, which optimizes heat utilization within the kiln. More specifically, the return dampers 200, 202 are operated so that the left return ducts 198 are open and the right return ducts 196 are closed, or the return dampers 200', 202' are operated so that the left return ducts 198' are open and the right return ducts 196' are closed, during the clockwise mode. As a result, the air moving device 178 draws air into the mixing chamber 174 of the furnace 16 from the left portion of the upper portion of the chamber interior space 54 during the clockwise mode. In contrast, the return dampers 200, 202 are operated so that the right return ducts 196 are open and the left return ducts 198 are closed, or the return dampers 200', 202' are operated so that the right return ducts 196' are open and the left return ducts 198' are closed, during the counterclockwise mode. As a result, the air moving device 178 draws air into the mixing chamber 174 from the right portion of the upper portion of the chamber interior space 54 during the counterclockwise mode.

In accordance with another aspect of the kiln 10, operation of the fans 20 is optimized by operating the control systems 150 that move the nozzle dampers 154, or by operating the control systems 150 that move the nozzle dampers 154', so that heated air is provided to the upper portion of the chamber interior space 54 substantially solely by either the right nozzles 148 or the left nozzles 150. More specifically, the nozzle dampers 154 or the nozzle dampers 154' carried by the left wall 130 of the intermediate plenum 68 are in their closed configurations and the nozzle dampers 154 or the nozzle dampers 154' carried by the right wall 128 of the intermediate plenum are in their open configurations while the fans 20 operate in the clockwise mode. As a result, any amount of heated air supplied from the composite plenum 18 to the upper portion of the chamber interior space 54 through the left nozzles 150 is substantially less than the amount of heated air supplied to the upper portion of the chamber interior space through the right nozzles 148 during the clockwise mode. In contrast, the nozzle dampers 154 or the nozzle dampers 154' carried by the right wall 128 of the intermediate plenum 68 are in their closed configurations and the nozzle dampers 154 or the nozzle dampers 154' carried by the left wall 130 of the intermediate plenum are in their open configurations while the fans 20 operate in the counterclockwise mode. As a result, any amount of heated air supplied from the composite plenum 18 to the upper portion of the chamber interior space 54 through the right nozzles 148 is substantially less than the amount of heat supplied to the upper portion of the chamber interior space through the left nozzles 152 during the counterclockwise mode.

In accordance with another aspect of the kiln 10, operation of the kiln 10 and, more particularly, operation of the fans 20 is optimized by the jet-like flow of heated air that is discharged by the nozzles 148, 150. Due to the strategic opening and closing of the nozzle dampers 154 as described above, the jet-like flow always originates proximate the discharge side of the fans 20, and the nozzles 148, 150 are oriented so that all of the discharge axes 152 of the nozzles are directed at least generally parallel to the rotational axes 214 of the fans 20. Because the heated gas introduced into the upper portion of the chamber interior space 54 flows at least generally parallel to the rotational axes of the fans 20 and at least generally in the same direction as the flow being discharged by the fans 20, the momentum of the flow along the recirculating flow path 204 is not sacrificed in order to accelerate the hot gas, which is supplied through the nozzles 148, 150, in the desired direction. More specifically, in accordance with one embodiment of the present invention, the hot gas introduced through the nozzles augments the flow from the fans 20 and serves to increase the velocity along the recirculating flow path 204 so that the velocity along the recirculating flow path is greater while the fans are operating and hot air is introduced through the nozzles than when the fans are operating and hot air is not supplied through the nozzles. Stated differently, the jet-like flow from the nozzles 148, 150 that are open has momentum that is mostly parallel to the rotational axes 214, and all of that momentum is in the downstream direction, which is the direction of flow defined by the exit velocity of the fans 20. The jet-like flow from the nozzles 148, 150 that are open has a velocity greater than the component of the exit flow from the fans 20 that extends in the direction of the rotational axes 214. As a result, any momentum exchange is such that the exit flow from the fans 20 experiences an increase in momentum in the downstream direction. More specifically, in accordance with one embodiment, the jet-like flow of heated air discharged from each of the nozzles 148, 150 that is open has a velocity at least as great as the velocity of the flow discharged from each of the fans 20, and more preferably the jet-like flow of heated air discharged from each of the nozzles that is open has a velocity of the order of 200 feet per second, whereas the flow discharged from each of the fans has a velocity of the order of 25 feet per second.

In addition, the nozzles 148, 150 are preferably arranged generally around the fans 20 and/or are in close proximity to the fans 20. This arrangement reduces the pressure near the exits of the fans 20 by means of Bernoulli's principle, thus further assisting the operation of the fans. More specifically, the static pressure near the jet-like flow is low because the velocity of the jet-like flow is high. That low pressure is proximate the exits of the fans 20 and provides a venturi effect at the exits of the fans. That venturi effect provides a slight suction to the exits of the fans 20 which enhances the operation of the fans 20.

In accordance with another aspect of the kiln 10, operation of the fans 20 is optimized because the blade tips 218 of the impellers 212 extend at least to, and preferably into, respective flow-induced boundary layers 220 (FIG. 3). This aspect of the kiln 10 will now be described with respect to the design and operation of the representative fan 20 and circulation passage 138 illustrated in FIG. 3, in accordance with one embodiment of the present invention. When the fan 20 is operated in the counterclockwise mode, the impeller 212 rotates about the rotational axis 214 and forces flow through the circulation passage 138, resulting in the formation of a flow-induced boundary layer 220. The flow-induced boundary layer 220 is schematically illustrated by dashed lines that are within the circulation passage 138 and adjacent the surface of the interior wall 140 that faces the impeller 212. The flow-induced boundary layer related aspects associated with the operation the fan 20 in the counterclockwise mode are identical to the flow-induced boundary layer aspects associated with the operation of the fan in the clockwise mode, except that the impeller rotates in the opposite direction and the flow-induced boundary layer originates proximate the left opening 146 to the circulation passage 138 rather than the right opening 144.

The fan 20 and the circulation passage 138 are constructed so that the blade tips 218 extend at least to, and preferably into, the flow-induced boundary layer 220 while the fan is operated, which restricts bypass flow proximate to the blade tips. The flow-induced boundary layer 220 extends generally uniformly for 360 degrees around the rotational axis 214 of the impeller 212, and each of the blade tips 218 remain within the flow-induced boundary layer as they rotate 360 degrees around the rotational axis. The internal diameter and length of the circulation passage 138 and the design and rotational speed of the impeller 212 are selected so that the blade tips 218 extend at least to, and preferably into, the flow-induced boundary layer 220 while the fan 20 is operated. For example, the impeller 212 is designed so that the blade tips 218 are proximate the interior wall 140 and the interior wall is sufficiently lengthy in the lateral direction so that the boundary layer 220 is sufficiently thick to contact the blade tips. More specifically, the right and left walls 128, 130 of the intermediate plenum 68 respectively define a right and left inlet plane. Inlet distances "d9" are respectively defined between the right and left inlet planes and the right-most and left-most leading edges of the blades 216. In addition, the impeller 212 defines a diameter "d10", and in the vicinity of the impeller the surface of the interior wall 140 upon which the boundary layer 220 forms defines an internal diameter "d11".

The impeller 212 and the circulation passage are preferably coaxial, and the internal diameter "d11" of the circulation passage 138 is preferably approximately 0.5 inches greater than the diameter "d10" of the impeller 212. Further, the inlet distance "d9" divided by the impeller diameter "d10" is preferably at least approximately 0.167, is more preferably in the range of approximately 0.167 to approximately 0.317, and is even more preferably approximately 0.317, and most preferably the inlet distance "d9" is approximately 2 feet and the impeller diameter is approximately 6 feet. In addition to playing a role in facilitating the preferred formation of the boundary layer 220, it is believed that the inlet distance "d9" of approximately 2 feet will allow the flow entering the impeller 212 to align itself with the impeller and begin a small amount of pre-swirl before entering the impeller.

The velocity into the impeller 212 depends upon the design of the blades 216, the pitch of the blades, and the rotational speed of the impeller. It is preferred for the blade tips 218 to have a velocity of approximately 298.5 ft/sec. The flow entering the impeller 212 travels along a spiral path because of the influence of the rotation of the impeller. The distance of the spiral path proximate the surface of the interior wall 140 upon which the boundary layer 200 forms may be estimated based upon the vector sum of the rotational and axial components of the velocity of the blades 216. The magnitude of the velocity along the spiral path proximate the surface of the interior wall 140 upon which the boundary layer 200 forms is similarly the sum of the axial and circumferential components of the velocity of the blades 216. The circumferential component increases as the flow approaches the leading edges of the blades 216. The velocity also varies radially since the peak work region of each blade 216 occurs at approximately 70% of the blade radius. The velocity of interest is adjacent the surface of the interior wall 140 upon which the boundary layer 220 forms. At this location the velocity will be reduced according to the spanwise distribution along the blade. This distribution peaks near 70% of the tip radius and is zero at the tip. The resultant distance and velocity are calculated using a time step average. For this case, the pertinent length of the spiral travel path proximate the surface of the interior wall 140 upon which the boundary layer 200 forms, which is "L" in the following equation, is approximately 16.2 feet, and the pertinent velocity along that spiral travel path, which is "U" in the following equation, velocity is approximately 202 feet/sec. The Reynolds number, Re, is defined as $$Re=\rho UL/\mu$$

where ρ is the fluid density and $\mu$ is the fluid viscosity. The Reynolds number provides the ratio of inertial and viscous effects in the flow. For this particular case, $Re=1.4\times10^7$ at the standard operating temperature of the kiln 10. The boundary layer 222 preferably grows along the interior wall 140 to a thickness such that the boundary layer fills the gap between the blade tips 218 and the interior wall 140.

The important parameter for quantifying the thickness of the boundary layer 222 at the blade tips 218 is known as the momentum thickness, θ. A method to estimate the momentum thickness θ is provided by Schlichtings formula where the momentum thickness for a turbulent boundary layer is given as $$\theta=0.036L(Re)^{-1/5}$$

Using this estimate and the value for "L" and "Re" provided above, the momentum thickness θ, or more specifically the thickness of the boundary layer 220, at the blade tips 218 is approximately 0.26 inches. As alluded to above, the gap between the blade tips 218 and the interior wall 140 is approximately 0.25 inches. That is, the inlet distance "d9" has been selected in view of expected velocities to produce a boundary layer thickness that is approximately equal to, and not substantially larger than, the gap between the blade tips 218 and the interior wall 140.

In accordance with another aspect of the kiln 10, operation of the fans 20 is optimized by providing one or more constricting regions proximate the inlets of the fans and one or more expanding regions proximate the outlets of the fans. Stated differently, one or more constrictions to the recirculating flow path 204 are provided on the low-pressure sides of the fans 20, and one or more expansions to the recirculating flow path are provided on the high-pressure sides of the fans. In accordance with the illustrated embodiment of the present invention, the protrusions 78, 84, 96, 100 of the upper and lower plenums 64, 66 and the right and left openings 144, 146 of the circulation passages 138 provide such constrictions and expansions.

As best understood with reference to FIG. 1, the front protrusions 78, 96 of the upper and lower plenums 64, 66 define a constriction to the recirculating flow path 204 proximate the inlets of the fans 20 so that airflow proximate the inlets of the fans is accelerated while the fans operate to provide counterclockwise flow along the recirculating flow path. In addition, the rear protrusions 84, 100 of the upper and lower plenums 64, 66 cooperate to define an expansion to the recirculating flow path 204 proximate the outlets of the fans 20 so that airflow proximate the outlets of the fans is decelerated while the fans operate to provide counterclockwise flow along the recirculating flow path. Likewise, the rear protrusions 84, 100 are constructed to define a constriction to the recirculating flow path 204 proximate the inlets of the fans 20 so that airflow proximate the inlets of the fans is accelerated while the fans are operated to cause clockwise flow along the recirculating flow path. The front protrusions 78, 96 are constructed to generally define an expansion to the recirculating flow path 204 proximate the outlets of the fans 20 so that airflow proximate the outlets of the fans is decelerated while the fans are operated to cause clockwise flow along the recirculating flow path.

As best understood with reference to the representative circulation passage 138 illustrated in FIG. 3, the right and left openings 144, 146 to the circulation passages are respectively shaped to provide constrictions to the recirculating flow path 204 proximate the inlets of the fans 20, so that airflow proximate to the inlets is accelerated, and expansions to the recirculating flow path proximate the outlets of the fans, so that airflow proximate the outlets is decelerated, while the fans are operated to provide counterclockwise flow along the recirculating flow path. Likewise, the right and left openings 144, 146 are respectively shaped to provide expansions to the recirculating flow path 204 proximate the outlets of the fans 20, so that airflow proximate the outlets is decelerated, and constrictions to the recirculating flow path proximate the inlets of the fans, so that airflow proximate the inlets is accelerated, while the fans are operated to provide clockwise flow along the recirculating flow path.

In accordance with another aspect of the kiln 10, mixing of the heated air within the upper portion of the chamber interior space 54 is facilitated by the arrangement of the nozzles 148, 150. The arrangement of the groups of left nozzles 150 illustrated in FIGS. 3–4 is generally representative of the arrangement of all of the right and left nozzles 148, 150 and will now be further described, in accordance with one embodiment of the present invention. The upper and lower groups of nozzles 150 include eight nozzles that are arranged in an arc. It is within the scope of the present invention for the groups to contain more or less nozzles. Further, for each of the groups of nozzles 150, two of the nozzles can be characterized as being end nozzles because they are at the opposite ends of the group, and the other nozzles of the group can be characterized as being middle nozzles because they are between the end nozzles. The discharge axes 152 of the middle nozzles 150 are preferably directed at least partially toward, and most preferably they intersect, the rotational axis 214 of the impeller 212. As best understood with reference to FIG. 4, the discharge axes of the end nozzles 150 do not intersect the rotational axis 214 of the impeller 212, but they are preferably directed at least partially toward, and most preferably they intersect, the common horizontal plane in which all rotational axes 214 extend. A majority of the end nozzles 150 can be characterized as being "shared" by adjacent fans 20.

Whereas the discharge axes 152 of the middle and end nozzles 150 respectively intersect the rotational axis 214 and the common horizontal plane in which the rotational axes 214 extend, those angles of intersection are preferably significantly less than 45 degrees in general and are preferably approximately 12 degrees. These inward angles enhance the mixing of the hot gas introduced into the upper portion of the chamber interior space 54, but they also detract somewhat from the above described advantage of having the discharge axes 152 extend at least generally parallel to the rotational axes 214 of the fans 20. Accordingly, an advantageous balance between the advantages has been determined to be achieved with the above mentioned angle of approximately 12 degrees. In accordance with another embodiment of the present invention, the discharge axes 152 are not oriented inwardly with respect to the rotational axes 214 or the like such that the discharge axes are horizontally extending and parallel to the rotational axes 214.

In accordance with another aspect of the kiln 10, mixing of the heated air within the upper portion of the chamber interior space 54 is facilitated by virtue of the blades 216 of different fans 20 being configured differently. That is, some of the impellers 212 are rotated clockwise about their respective axes 214 to provide clockwise flow along the flow path 204, whereas other of the impellers are rotated counterclockwise about their respective axes to provide clockwise flow along the flow path. Likewise, some of the impellers 212 are rotated clockwise about their respective axes 214 to provide counterclockwise flow along the flow path 204, whereas other of the impellers are rotated counterclockwise about their respective axes to provide counterclockwise flow along the flow path.

In accordance with another aspect of the kiln 10, mixing of the heated air within the upper portion of the chamber interior space 54 is facilitated by virtue of elongate splitter plates (not shown) being positioned in the upper portion of the chamber interior space. The splitter plates are disclosed in U.S. Pat. No. 5,414,944, which is incorporated herein by reference.

In accordance with another aspect of the kiln 10, the flow through the charge 14 of lumber is at least partially balanced by virtue of the right edge 110 of the lower wall 62 of the lower plenum 66 extending laterally beyond the charge-receiving area. More specifically, the overhang of the lower plenum 66 that is provided by the placement of the right edge 110 allows the clockwise flow from the upper portion of the chamber interior space 54 to the lower portion of the chamber interior space 30 to make an efficient turn so that entry of the airflow into the charge 14 of lumber is more generally "straight-on," which promotes optimal airflow between the top layers of the charge of lumber. The right radius of curvature 104 and the right flange 118 also enhance this effect. In addition, the overhang of the lower plenum 66 that is provided by the placement of the right edge 110 functions to reduce a venturi-like effect that can be caused by upward airflow proximate the right-most top edge of the charge 14 of lumber. Left unchecked, the up-flow can draw a considerable flow through upper layers of the right-most stack of lumber, which can cause too rapid drying of those upper layers. The overhang provided by the right edge 110 reduces the venturi-like effect by moving the up-flow away from the charge 14 of lumber. Positioning the right side wall 46 the distance "d1" from the charge 14 of lumber also decreases the speed of the up-flow, which correspondingly decreases the venturi-like effect.

In accordance with another aspect of the kiln 10, the flow through the charge 14 of lumber is at least partially balanced by virtue of the left edge 112 of the lower wall 62 of the lower plenum 66 extending beyond the charge-receiving area. More specifically, the overhang of the lower plenum 66 that is provided by the placement of the left edge 112 allows the counterclockwise flow from the upper portion of the chamber interior space 54 to the lower portion of the chamber interior space 30 to make an efficient turn so that entry of the airflow into the charge 14 of lumber is more generally "straight-on," which promotes optimal airflow between the top layers of the charge of lumber. The left radius of curvature 106 and the left flange 120 also enhance this effect. In addition, the overhang of the lower plenum 66 that is provided by the placement of the left edge 112 functions to reduce a disadvantageous venturi-like effect that can be caused by upward airflow proximate the left-most top edge of the charge 14 of lumber. Positioning the left side wall 48 the distance "d1" from the charge 14 of lumber also decreases the venturi-like effect.

In accordance with one example, after a charge 14 of green lumber has been dried within the lower portion of the chamber interior space 30, at least the rear doors 44 are opened and the dried charge of lumber is removed from the lower portion of the chamber interior space through the rear door opening 42.

The above and other aspects of the kiln 10 are advantageous because they are pertinent to either the efficient construction, the efficient operation, or timely operation of the kiln.

This patent application incorporates by reference the U.S. patent application filed on Mar. 22, 2000 in the name of Robert T. Nagel et al. and entitled Improved Kiln and Kiln-Related Structures, and Associated Methods.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A kiln for drying at least one stack of lumber, the kiln comprising:

a kiln chamber defining a chamber interior space capable of receiving at least the stack of lumber for drying;

a furnace capable of providing heated air;

a plenum in communication with the furnace so that the plenum is capable of receiving the heated air from the furnace;

an air moving device capable of circulating air in the chamber interior space along a flow path;

a plurality of elongate conduits in communication with the plenum, wherein each conduit:

extends into at least a portion of the flow path, has opposite ends, defines a length that extends between the opposite ends and is generally perpendicular to the portion of the flow path into which the conduit extends, defines a plurality of outlets positioned along at least a section of the length of the conduit and proximate the flow path so that the conduit is capable of providing heated air from the plenum to the flow path via the outlets, defines a first cross-dimension that is generally perpendicular to the length of the conduit and parallel to the portion of the flow path into which the conduit extends, and defines a second cross-dimension that is generally perpendicular to both the length of the conduit and the portion of the flow path into which the conduit extends, wherein the second cross-dimension is less than the first cross-dimension, whereby the conduit defines a low profile with respect to the portion of the flow path into which the conduit extends.

2. A kiln according to claim 1, wherein the kiln chamber comprises:

a lower chamber portion defining a lower portion of the chamber interior space that is capable of receiving at least the stack of lumber for drying, wherein the conduits extend into the lower portion of the chamber interior space, and an upper chamber portion positioned above the lower chamber portion and defining an upper portion of the chamber interior space that at least partially contains the plenum.

3. A kiln according to claim 1, wherein for each conduit a cross-section thereof taken perpendicular to the length thereof is generally elliptical and defines a pair of first vertices between which the first cross-dimension is defined and a pair of second vertices between which the second cross-dimension is defined.

4. A kiln according to claim 3, wherein the outlets are closer to the second vertices than to the first vertices.

5. A kiln according to claim 3, wherein the outlets are proximate the second vertices.

6. An air moving system capable of bringing air from two different locations together, the air moving system comprising:

a first air moving device capable of moving air along a first flow path;

a second air moving device capable of moving air along a second flow path; and an elongate conduit through which at least a portion of the second flow path extends, wherein the conduit:

extends into at least a portion of the first flow path, has opposite ends, defines a length that extends between the opposite ends and is generally perpendicular to the portion of the first flow path, defines a plurality of outlets positioned along at least a section of the length of the conduit and proximate the first flow path, wherein at least a portion of the second flow path extends through each of the outlets so that the conduit is capable of introducing air flowing along the second flow into the first flow path, defines a first cross-dimension that is generally perpendicular to the length of the conduit and parallel to the portion of the first flow path, and defines a second cross-dimension that is generally perpendicular to both the length of the conduit and the portion of the first flow path, wherein the second cross-dimension is less than the first cross-dimension, whereby the conduit defines a low profile with respect to the first flow path.

7. An air moving system according to claim 6, wherein for each conduit a cross-section thereof taken perpendicular to the length thereof is generally elliptical and defines a pair of first vertices between which the first cross-dimension is defined and a pair of second vertices between which the second cross-dimension is defined.

8. An air moving system according to claim 7, wherein the outlets are closer to the second vertices than to the first vertices.

9. An air moving system according to claim 7, wherein the outlets are proximate the second vertices.

10. A reheater conduit that is capable of being used in a kiln, wherein the conduit:

has opposite ends, defines a length that extends between the opposite ends, defines a pair of first vertices between which a first cross-dimension is defined, wherein the first cross-dimension is generally perpendicular to the length, defines a pair of first vertices between which a second cross-dimension is defined, wherein the second cross-dimension is generally perpendicular to the length, and wherein the second cross-dimension is less than the first cross-dimension, and defines at least a plurality of outlets that are closer to the second vertices than to the first vertices.

11. A reheater conduit according to claim 10, wherein the a first group of the outlets are proximate one of the second vertices and a second group of the outlets are proximate the other of the second vertices, and outlets of the first group are staggered with respect to outlets of the second group.

12. A kiln for drying at least one stack of lumber, the kiln comprising:

a kiln chamber defining a chamber interior space and a stack-receiving space that is within the chamber interior space and capable of receiving at least the stack of lumber for drying;

a furnace capable of providing heated air;

a plenum in communication with the furnace so that the plenum is capable of receiving the heated air from the furnace;

an air moving device capable of circulating air in the chamber interior space along a flow path that extends through the stack-receiving space; and a plurality of elongate conduits connected to and in communication with the plenum, wherein each conduit:

extends into at least a portion of the flow path that is upstream from the stack-receiving space, has opposite ends, defines a length that extends between the opposite ends and is generally perpendicular to the portion of the flow path into which the conduit extends, and defines a plurality of outlets positioned along at least a section of the length of the conduit and proximate the flow path so that the conduit is capable of providing heated air from the plenum to the flow path via the outlets, and wherein for a pair of adjacent conduits at least a first outlet of a first conduit of the pair and at least a second outlet of a second conduit of the pair are arranged so that the heated air introduced to the flow path via the first and second outlets cooperates to produce a whirling mass of air that travels downstream along the flow path to the stack-receiving space while the kiln is operating.

13. A kiln according to claim 12, wherein the first outlet is positioned above the second outlet.

14. A kiln according to claim 13, wherein:

the first outlet is oriented at least generally toward the second conduit; and the second outlet is oriented at least generally toward the first conduit.

15. A kiln according to claim 12, wherein for the pair of adjacent conduits a first group of the outlets of the first conduit and a second group of the outlets of the second conduit are arranged so that the heated air introduced to the flow path via the first and second groups of outlets cooperates to produce a whirling mass of air that travels downstream along the flow path to the stack-receiving space.

16. A kiln according to claim 15, wherein the first group of the outlets is positioned above the second group of the outlets.

17. A kiln for drying at least one stack of lumber, the kiln comprising:

a kiln chamber defining a chamber interior space that is capable of receiving at least the stack of lumber for drying;

a furnace capable of providing heated air;

a plenum in communication with the furnace so that the plenum is capable of receiving the heated air from the furnace;

an air moving device capable of circulating air in the chamber interior space along a flow path; and a plurality of elongate conduits connected to and in communication with the plenum, wherein each conduit:

extends into at least a portion of the flow path so that a boundary layer is formed around at least a portion of the conduit while the air moving device is operating, and defines at least one outlet positioned proximate the flow path so that the conduit is capable of providing heated air from the plenum to the flow path via the outlet, and wherein a pair of adjacent conduits are arranged and the kiln is operative so that heated air provided through at least a first outlet of a first conduit of the pair interacts with the boundary layer around a second conduit of the pair while the kiln is operating, so that the boundary layer around the second conduit is smaller than it would be absent the heated air provided by the first outlet.

18. A kiln according to claim 13, wherein the first outlet is oriented at least generally toward the second conduit.

19. A kiln for drying at least one stack of lumber, the kiln comprising:

a kiln chamber defining a chamber interior space capable of receiving at least the stack of lumber for drying;

a furnace capable of providing heated air;

a plenum capable of receiving the heated air from the furnace;

an air moving device capable of circulating air in the chamber interior space along a flow path; and a plurality of elongate conduits connected to and in communication with the plenum, wherein each conduit:

extends into at least a portion of the flow path, comprises an upper end connected to and in communication with the plenum, an opposite lower end, and an internal converging/diverging section proximate the upper end, and defines at least one outlet positioned proximate the flow path so that the conduit is capable of providing heated air from the plenum to the flow path via the outlet; and a plurality of movable dampers respectively proximate the upper ends of the conduits and capable of being moved to respectively adjust the amount of heated air that is capable of being provided to the flow path from the conduits.

20. A method of drying lumber, comprising moving air along a flow path that extends at least through an upstream stack of lumber and a downstream stack of lumber that is positioned downstream from the upstream stack of lumber, wherein the downstream stack of lumber comprises a plurality of generally horizontally extending layers of lumber positioned one above the other so that each of the adjacent layers of lumber are vertically spaced apart from one another and define at least one passage therebetween, and the air is moved along the flow path so that air flows through the passages defined by the layers of lumber to at least partially dry the lumber, whereby boundary layers that are restrictive to flow are formed proximate the layers of lumber; and introducing a plurality of whirling masses of air into the flow path at a position that is between the upstream and downstream stacks of lumber so that turbulence associated with the whirling masses of air interacts with the downstream stack of lumber and reduces the resistance to flow through the downstream stack of lumber.

21. A method according to claim 20, wherein the step of introducing a plurality of whirling masses of air into the flow path comprises introducing heated air into the flow path through outlets of adjacent conduits.

22. A method of drying lumber, comprising moving air along a flow path that extends through a stack of lumber; and introducing flows of heated air into the flow path via conduits that extend into the flow path, whereby for each conduit a boundary layer is formed generally therearound and the boundary layer comprises a separated region, wherein the step of introducing flows of heated air into the flow path comprises directing the flows of heated air toward the boundary layers so that the flows of heated air interact with the boundary layers in a manner that causes the separated regions of the boundary layers to be smaller than they would be absent the flows of heated air, whereby convective heat transfer from the conduits is enhanced.

23. A method according to claim 22, wherein:

the stack of lumber comprises a plurality of generally horizontally extending layers of lumber positioned one above the other so that each of the adjacent layers of lumber are vertically spaced apart from one another and define at least one passage therebetween, and the air is moved along the flow path so that air flows through the passages defined by the layers of lumber to at least partially dry the lumber, whereby boundary layers that are restrictive to flow are formed proximate the layers of lumber; and the step of introducing heated air into the flow path further comprises introducing a plurality of whirling masses of air into the flow path so that turbulence associated with the whirling masses of air interacts with the stack of lumber and reduce the resistance to flow through the stack of lumber.

24. A method according to claim 22, wherein the step of directing flows of heated air comprises introducing a plurality of jet-like flows into the flow path from each conduit.

* * * * *